US012196435B2

(12) United States Patent
Zhou

(10) Patent No.: US 12,196,435 B2
(45) Date of Patent: Jan. 14, 2025

(54) WINDOW AIR CONDITIONER

(71) Applicants: GD MIDEA AIR-CONDITIONING EQUIPMENT CO., LTD., Guangdong (CN); MIDEA GROUP CO., LTD., Guangdong (CN)

(72) Inventor: Junhua Zhou, Guangdong (CN)

(73) Assignees: GD MIDEA AIR-CONDITIONING EQUIPMENT CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 117 days.

(21) Appl. No.: 17/952,777

(22) Filed: Sep. 26, 2022

(65) Prior Publication Data

US 2023/0028921 A1 Jan. 26, 2023

Related U.S. Application Data

(63) Continuation of application No. PCT/CN2021/080680, filed on Mar. 15, 2021.

(30) Foreign Application Priority Data

Jun. 2, 2020 (CN) ..... 202010493420.3
Jun. 2, 2020 (CN) ..... 202020990036.X
(Continued)

(51) Int. Cl.
*F24F 1/031* (2019.01)
*F24F 11/65* (2018.01)

(52) U.S. Cl.
CPC ..... *F24F 1/031* (2019.02); *F24F 11/65* (2018.01)

(58) Field of Classification Search
CPC .. F24F 1/027; F24F 1/028; F24F 1/031; F24F 11/65
See application file for complete search history.

(56) References Cited

U.S. PATENT DOCUMENTS

2020/0182489 A1* 6/2020 Clark ..... F24F 11/30
2021/0164668 A1* 6/2021 Zhou ..... F24F 1/028
(Continued)

FOREIGN PATENT DOCUMENTS

CN 101799200 A 8/2011
CN 104676774 A 6/2015
(Continued)

OTHER PUBLICATIONS

International Search Report and Written Opinion dated May 27, 2021 received in International Application No. PCT/CN2021/080680.
(Continued)

*Primary Examiner* — Marc E Norman
(74) *Attorney, Agent, or Firm* — Scully, Scott, Murphy & Presser, P.C.

(57) ABSTRACT

A window air conditioner is disclosed. The window air conditioner has a casing, an indoor heat exchanger, an indoor wall and a fresh air housing. The casing has an indoor air inlet and an indoor air outlet, and the indoor heat exchanger is mounted in the housing and corresponds to the indoor air inlet. The indoor wall is mounted in the casing, and has an indoor air duct for communicating an air outlet side of the indoor heat exchanger with the indoor air outlet. The fresh air housing is installed in the casing, and has a fresh air inlet, and a first fresh air outlet and a second fresh air outlet communicated with the fresh air inlet. The first fresh air outlet is located on the air inlet side of the indoor heat exchanger, and the second fresh air outlet is communicated with the indoor air duct.

20 Claims, 11 Drawing Sheets

(30) Foreign Application Priority Data

Jun. 2, 2020 (CN) ..... 202020990204.5
Jun. 2, 2020 (CN) ..... 202020990916.7

(56) References Cited

U.S. PATENT DOCUMENTS

| | | | | |
|---|---|---|---|---|
| 2021/0356145 | A1* | 11/2021 | Lei | F24F 13/32 |
| 2022/0275950 | A1* | 9/2022 | Zhou | F24F 1/028 |

FOREIGN PATENT DOCUMENTS

| | | | |
|---|---|---|---|
| CN | 105783121 | A | 7/2016 |
| CN | 107461829 | A | 12/2017 |
| CN | 207094981 | U | 3/2018 |
| CN | 109764415 | A | 5/2019 |
| CN | 209147273 | U | 7/2019 |
| CN | 210118880 | U | 2/2020 |
| CN | 210128436 | U | 3/2020 |
| CN | 210179775 | U | 3/2020 |
| CN | 212511502 | U | 2/2021 |
| CN | 212511503 | U | 2/2021 |
| JP | 2003130443 | A | 5/2003 |

OTHER PUBLICATIONS

First Office Action dated Nov. 28, 2024 received in Chinese Patent Application No. 202010493420.3.

* cited by examiner

WINDOW AIR CONDITIONER

CROSS-REFERENCE TO RELATED APPLICATIONS

This application is a continuation application of PCT International Patent Application No. PCT/CN2021/080680, filed on Mar. 15, 2021, which claims priority to and benefits of Chinese Patent Application Nos. 202010493420.3, 202020990036.X, 202020990916.7 and 202020990204.5, all titled "Window Air Conditioner" and filed on Jun. 2, 2020. The entire disclosures of the aforementioned applications are incorporated in this application by reference for all purposes. No new matter has been introduced.

FIELD

The present application relates to the field of air conditioning, and in particular, to a window air conditioner.

BACKGROUND

A window air conditioner is usually mounted on a window frame of a wall, and is used for cooling or heating the indoors. With the increasing demand of clean air by users, the window air conditioner having a fresh air function appears. For this type of window air conditioner, a fresh air housing is usually added in the housing of the window air conditioner to introduce fresh air of the outdoors into the indoors. However, the conventional fresh air housing has only a single manner of air outlet, which results in a poor air outlet effect.

SUMMARY

The main object of this application is to provide a window air conditioner, which aims to at least provide a new air outlet mode of the fresh air housing, and improve the air outlet effect of the fresh air housing.

In order to achieve at least the above object, this application provides a window air conditioner including:

- a casing configured with an indoor air inlet and an indoor air outlet;
- an indoor heat exchanger mounted in the casing and corresponding to the indoor air inlet;
- an indoor wall mounted in the casing and configured with an indoor air duct for communicating an air outlet side of the indoor heat exchanger with the indoor air outlet; and
- a fresh air housing mounted in the casing and configured with a fresh air inlet, and a first fresh air outlet and a second fresh air outlet in communication with the fresh air inlet, where the first fresh air outlet is located on an air inlet side of the indoor heat exchanger, and the second fresh air outlet is in communication with the indoor air duct.

Optionally, the fresh air housing includes an air inlet portion provided with the fresh air inlet, an air outlet portion located between the indoor heat exchanger and the indoor air inlet, and an air guiding portion for communicating the air inlet portion with the air outlet portion. The air outlet portion is provided with the first fresh air outlet and the air guiding portion is provided with the second fresh air outlet. The fresh air housing further includes an air directing portion for communicating the air guiding portion with the air outlet portion. The air directing portion is of a flat shape and extended from the air guiding portion, passed through a lower end of the indoor heat exchanger, and connected to a lower end of the air outlet portion.

Optionally, the window air conditioner further includes a first air guiding member disposed at the first fresh air outlet, and the first air guiding member is configured to guide fresh air to blow obliquely downward into indoors from the first fresh air outlet. An upper wall plate is located at a top of the air outlet portion, and a front edge of the upper wall plate forms an upper edge of the first fresh air outlet. A surface of the upper wall plate is inclined downward from a rear side to a front side of the upper wall plate, and the first air guiding member is formed by the upper wall plate.

Optionally, the indoor air inlet is provided with a plurality of air inlet louvers arranged at intervals in an up-down direction, air inlet louvers located at a lower end of the indoor air inlet correspond to the first fresh air outlet, and surfaces of the air inlet louvers are inclined downward from a rear side to a front of the air inlet louvers. A rear edge of at least one air inlet louver corresponds to a front edge of the upper wall plate of the air outlet portion, and an inclination angle of the at least one air inlet louver is consistent with an inclination angle of the upper wall plate.

Optionally, the fresh air housing further includes a wind deflector configured on the air outlet portion, and the wind deflector is located at or close to an upper edge of the first fresh air outlet and extends along a length direction of the upper edge of the first fresh air outlet. The window air conditioner further includes an air inlet filter screen disposed between the indoor heat exchanger and the indoor air inlet, the wind deflector is located behind the air inlet filter screen, and a front surface of the wind deflector is abutted against a rear surface of the air inlet filter screen.

Optionally, the window air conditioner includes an air duct housing arranged in the indoor wall to form the indoor air duct, and an air supply port is formed on the air duct housing to communicate the second fresh air outlet with the indoor air duct. The window air conditioner further includes a second air guiding member provided at the air supply port.

Optionally, the second air guiding member is an air guiding plate arranged at the air supply port, and a surface of the air guiding plate is inclined towards the indoor fan from a lower edge of the air guiding plate to an upper edge of the air guiding plate. A plurality of air guiding plates are provided, and the plurality of air guiding plates are arranged at intervals in an up-down direction of the air supply port. Inclined directions of surfaces of the plurality of air guiding plates are consistent with each other. The air supply port is composed of a plurality of strip-shaped ventilation holes distributed along the up-down direction. The plurality of air guiding plates correspond to the plurality of strip-shaped ventilation holes one to one, and a lower side of each air guiding plate is connected to a lower edge of a corresponding strip-shaped ventilation hole.

According to the technical solution of this application, fresh air is delivered by using the first fresh air outlet and the second fresh air outlet of the fresh air housing. By adopting this air outlet mode of the fresh air housing, the inlet amount of the fresh air can be greatly increased, and the air outlet effect of the fresh air housing can be improved. Furthermore, an airflow circulation between the lower space and the upper space can be formed, airflow is accelerated, more fresh air is driven to enter the room, and the airflow replacement efficiency in the room is effectively improved.

BRIEF DESCRIPTION OF THE DRAWINGS

In order to more clearly explain the embodiments of this application or the technical solutions in the related art, the drawings used in the description of the embodiments or the related art will be briefly introduced below. Obviously, the drawings in the following description are merely some embodiments of this application. For those of ordinary skill in the art, other drawings can be obtained based on the structure shown in these drawings without creative work.

Figure 1:
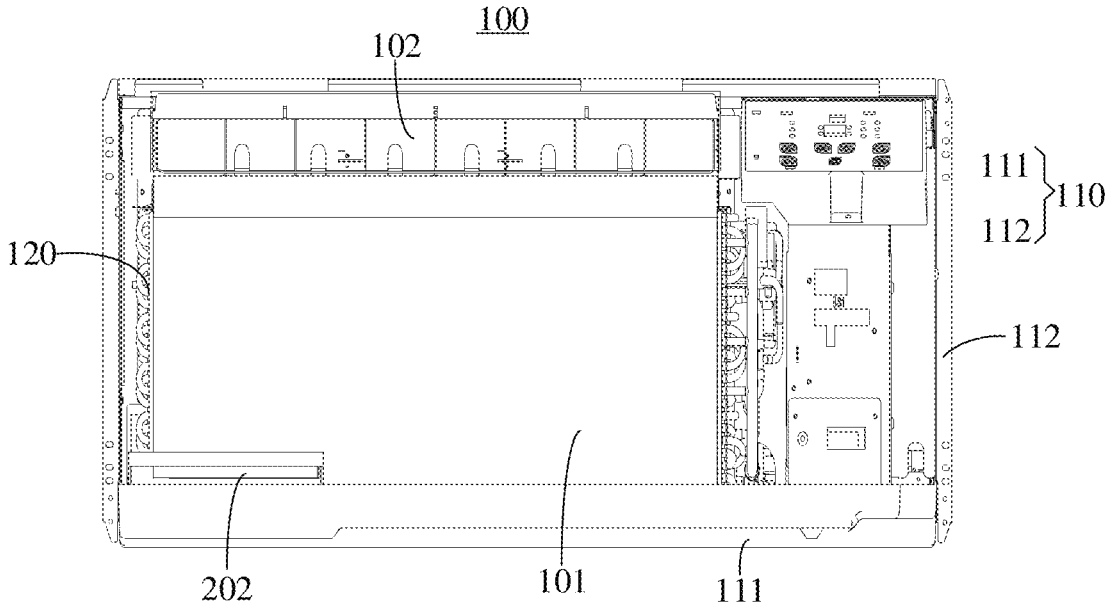
FIG. 1 is a front view of an embodiment of a window air conditioner of this application.

Description of reference numerals shown in the figures is provided in the following table.

| Reference numeral | Name |
|---|---|
| 100 | Window air conditioner |
| 110 | Casing |
| 111 | Chassis |
| 112 | Housing |
| 1121 | Indoor housing |
| 1122 | Outdoor housing |
| 1123 | Housing back plate |

-continued

| Reference numeral | Name |
|---|---|
| 120 | Indoor heat exchanger |
| 121 | First indoor heat exchanger |
| 122 | Second indoor heat exchanger |
| 130 | Outdoor heat exchanger |
| 140 | Indoor fan |
| 150 | Outdoor fan |
| 160 | Indoor wall |
| 161 | Rear wall plate |
| 170 | Air duct enclosure |
| 180 | Compressor |
| 181 | Exhaust pipe |
| 182 | Suction pipe |
| 190 | Air duct housing |
| 191 | Air duct back plate |
| 192 | Air supply port |
| 1921 | Strip-shaped ventilation holes |
| 193 | Air guiding plate/second air guiding member |
| 1102 | Outdoor portion |
| 1101 | Indoor portion |
| 101 | Indoor air inlet |
| 102 | Indoor air outlet |
| 103 | Indoor air duct |
| 104 | Air inlet louver |
| 105 | Air inlet filter screen |
| 200 | Fresh air housing |
| 210 | Air inlet portion |
| 220 | Air guiding portion |
| 2201 | Air guiding wall |
| 2202 | Mounting slot |
| 2203 | Mounting protruding strip |
| 221 | First air guiding section |
| 222 | Second air guiding section |
| 223 | Baffle |
| 230 | Air directing portion |
| 231 | Horizontal section |
| 240 | Air outlet portion |
| 241 | Front wall plate |
| 242 | Upper wall plate/First air guiding member |
| 243 | Wind deflector |
| 201 | Fresh air inlet |
| 202 | First fresh air outlet |
| 203 | Second fresh air outlet |
| 300 | Fresh air fan |

-continued

| Reference numeral | Name |
|---|---|
| 400 | Filter |
| 510 | First valve |
| 520 | Second valve |
| 610 | First pipe |
| 620 | Second pipe |
| 700 | Switching device |
| 810 | First air door |
| 820 | Second air door |

The realization of the objectives, functional features and advantages of this application will be further explained with reference to the accompanying drawings in combination with the embodiments.

DETAILED DESCRIPTION OF EMBODIMENTS

The technical solutions in the embodiments of this application will be clearly and completely described below with reference to the accompanying drawings in the embodiments of this application. Obviously, the described embodiments are only a part of the embodiments of this application, and not all of the embodiments. Based on the embodiments in this application, all other embodiments obtained by those skills in the art without creative labor falls in the scope of this application.

It should be noted that all directional indications (such as up, down, left, right, front, back, etc.) in the embodiments of this application are only used to explain the relative positional relationship, movement conditions, etc. between the components under a specific posture (as shown in the drawings). If the specific posture changes, the directional indications are changed accordingly.

In addition, the descriptions related to "first", "second" and the like in this application are for descriptive purposes only, and should not be understood as indicating or implying their relative importance or implicitly indicating the number of technical features indicated. Therefore, a feature defined by "first" and "second" may explicitly or implicitly include at least one of such feature. In addition, the technical solutions of the embodiments may be combined with each other, but must be based on what those skilled in the art can achieve. When the combination of the technical solutions is contradictory or cannot be realized, it should be considered that the combination of the technical solutions does not exist, and is not within the claimed scope of this application.

FIG. 1 to FIG. 20 are drawings of embodiments of a window air conditioner of this application. In the embodiments of the window air conditioner provided by this application, the window air conditioner is formed by integrating an indoor unit with an outdoor unit, and the window air conditioner is installed on a window frame of a building, to realize the cooling or heating of the indoors. The window air conditioner can further provide a new air outlet mode of the fresh air housing, and improve an air outlet effect of the fresh air housing. Embodiments of the window air conditioner will be described below.

Figure 2:
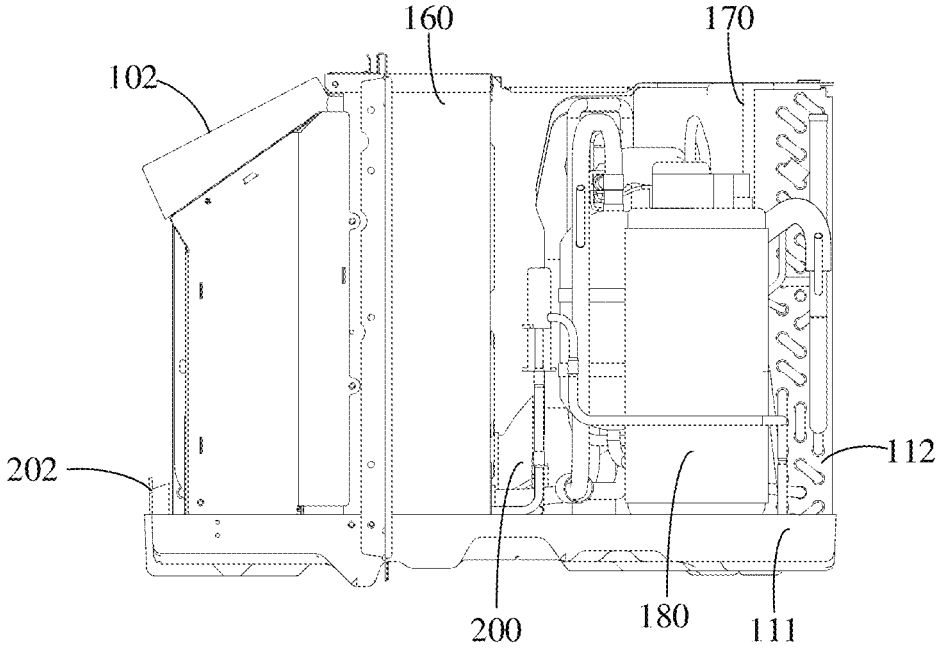
FIG. 2 is a right view of the window air conditioner of FIG. 1.
Figure 3:
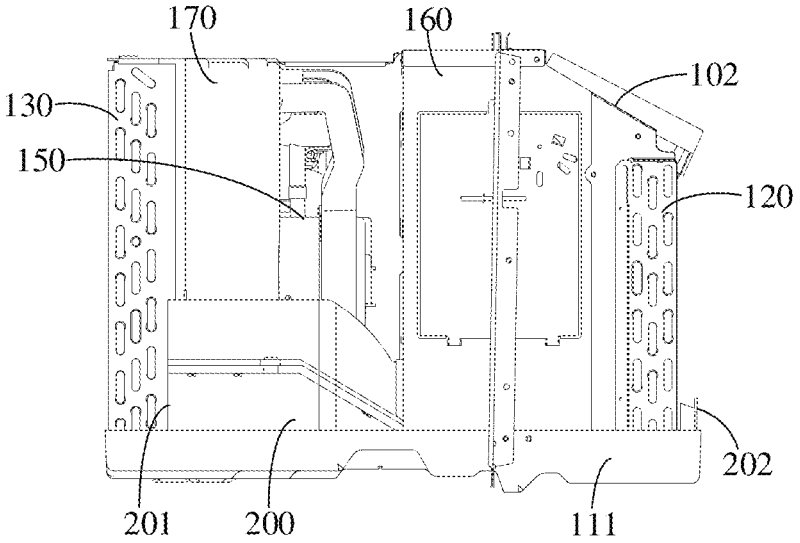
FIG. 3 is a left view of the window air conditioner of FIG. 2.
Figure 11:
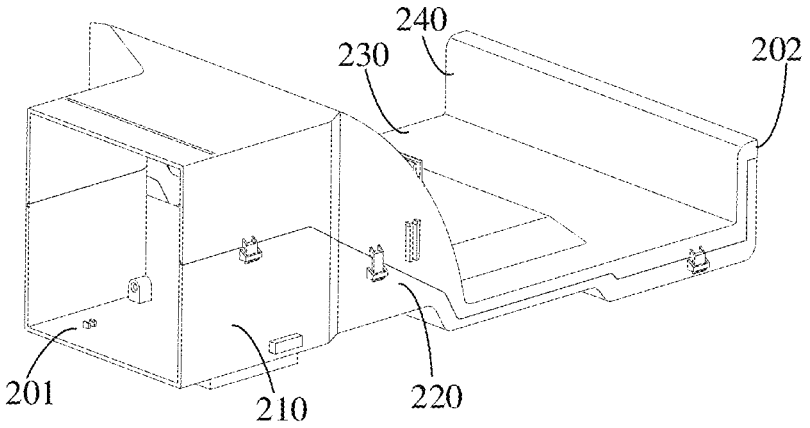
FIG. 11 is a schematic structural view of the fresh air housing of the window air conditioner according to an embodiment of this application.

Referring to FIG. 1 to FIG. 3, in an embodiment of the window air conditioner 100 of this application, the window air conditioner 100 includes a casing 110, an indoor wall 160, and an indoor heat exchanger 120. The casing 110 is configured with an indoor air inlet 101 and an indoor air outlet 102. The indoor heat exchanger 120 is mounted in the casing 110 and corresponds to the indoor air inlet 101. The indoor wall 160 is mounted in the casing 110, and configured with an indoor air duct 103 for communicating an air outlet side of the indoor heat exchanger 120 with the indoor air outlet 102. The window air conditioner 100 further includes a fresh air housing 200 mounted in the casing 110. The fresh air housing 200 is configured with a fresh air inlet 201, and a first fresh air outlet 202 and a second fresh air outlet 203 (as shown in FIG. 11) in communication with the fresh air inlet 201. The first fresh air outlet 202 is located on the air inlet side of the indoor heat exchanger 120, and the second fresh air outlet 203 is in communication with the indoor air duct 103.

The casing 110 includes a chassis 111 and a housing 112 mounted on the chassis 111, and the housing 112 has a front surface, a back surface, a side surface and a top surface. The whole of the top surface may be a horizontal plane, or may consist of a plane and an inclined surface connected to a front end of the plane. The front surface of the housing 112 is provided with an indoor air inlet 101, and a top front end of the casing 110 (i.e., the inclined surface) is provided with an indoor air outlet 102. The housing 112 includes an indoor housing 1121 and an outdoor housing 1122. The indoor air inlet 101 is formed on a front side of the indoor housing 1121, and the indoor air outlet is formed on a top of the indoor housing 1121. An outdoor air inlet is formed on a back surface of the outdoor housing 1122, and an outdoor air outlet is formed on a side surface or a top of the outdoor housing 1122.

According to a state of the window air conditioner 100 being installed on the window, the casing 110 can be divided into an indoor portion 1101 and an outdoor portion 1102, and after the window air conditioner 100 is mounted on the window, the indoor portion 1101 of the casing 110 corresponds to the indoors, and the outdoor portion 1102 corresponds to the outdoors. The window air conditioner 100 further includes an indoor heat exchanger 120, an outdoor heat exchanger 130, an outdoor fan 150, an indoor fan 140 and a compressor 180. The outdoor heat exchanger 130, the outdoor fan 150, and the compressor 180 are both located in the outdoor portion 1102 of the casing 110 (that is, being mounted in the outdoor housing 1122), the outdoor heat exchanger 130 corresponds to the outdoor air inlet, and the outdoor fan 150 is mounted in an air duct enclosure 170 of the outdoor portion 1102 and located on an air outlet side of the outdoor heat exchanger 130. The indoor heat exchanger 120 and the indoor fan 140 are located in the indoor portion 1101 of the casing 110 (that is, being mounted in the indoor housing 1121).

When the window air conditioner 100 is in a cooling or heating mode, air of the indoors is driven by the indoor fan 140 to enter the indoor portion 1101 from the indoor air inlet 101, then the air passes through the indoor heat exchanger 120 to exchange heat and enters the indoor air duct 103 from the indoor heat exchanger 120, and finally the air is driven by the indoor fan 140 to be blown out from the indoor air outlet 102 to achieve cooling or heating of the indoors. Meanwhile, air of the outdoors is driven by the outdoor fan 150 to enter the outdoor portion 1102 from the outdoor air inlet, then the air passes through the outdoor heat exchanger 130 to exchange heat and enters the outdoor air duct from the outdoor heat exchanger 130, and finally the air is driven by the outdoor fan 150 to be blown out from the outdoor air outlet.

The fresh air housing 200 may be mounted on a left side or a right side of the casing 110, and the fresh air housing 200 extends from the outdoor portion 1102 of the casing 110 to the indoor portion 1101 of the casing 110. The fresh air inlet 201 of the fresh air housing 200 is adapted to communicate with the outdoors. The first fresh air outlet 202 and the second fresh air outlet 203 of the fresh air housing 200 are adapted to supply air to the indoors. The first fresh air outlet 202 is located between the air inlet side of the indoor heat exchanger 120 and the indoor air inlet 101, thus the fresh airflow blown out from the first fresh air outlet 202 can be blown out to the indoors directly from the indoor air inlet 101 (as shown by $F_1$ in FIG. 6), and a portion of the airflow, together with the indoor air, flows back from the air inlet side of the indoor heat exchanger 120 to the indoor air duct 103 (as shown by $F_3$ in FIG. 6). The airflow blown out by the second fresh air outlet 203 directly enters the indoor air duct 103, namely an air outlet side of the indoor heat exchanger 120 (as shown by $F_2$ in FIG. 6). A fresh air duct 204 is formed inside the fresh air housing 200, and the fresh air duct 204 communicates the fresh air inlet 201 with both the first fresh air outlet 202 and the second fresh air outlet 203.

Figure 6:
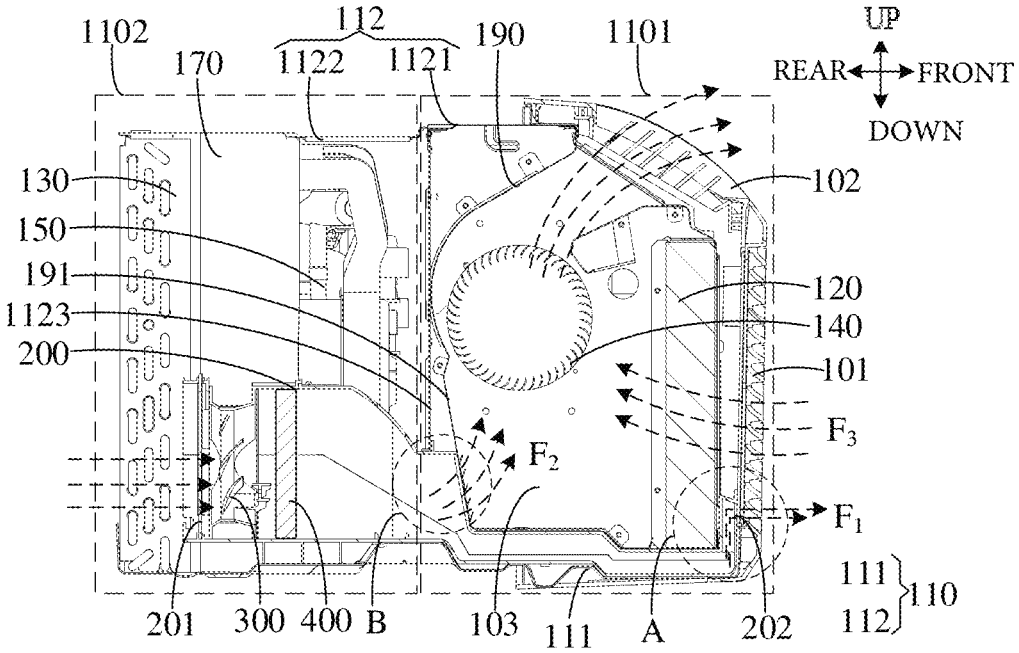
FIG. 6 is a cross-sectional view taken along lines I-I in FIG. 5.

Referring to FIG. 6 and FIG. 11, when a fresh air mode is turned on for the window air conditioner 100, the fresh air of the outdoors enters the fresh air duct 204 inside the fresh air housing 200 from the fresh air inlet 201, and is divided into two fresh air airflows. The two airflows in the fresh air duct 204 is blown out from the first fresh air outlet 202 and the second fresh air outlet 203, respectively. It can be seen from the foregoing description that the airflow blown from the first fresh air outlet 202 flows to a lower portion of the indoor space, and the airflow blown out from the second fresh air outlet 203 is driven by the indoor fan 140 to flow through the indoor air duct 103 and the indoor air outlet to a middle portion and an upper portion of the indoor space. Therefore, the fresh air is distributed in the upper, middle and lower portions of the indoor space, and the distribution of the fresh air in a room is improved. Moreover, after the airflow blown from the second fresh air outlet 203 is mixed with the airflow for which heat exchange is performed and then blown out from the indoor air outlet, the airflow will flow to the lower space and push the airflow in the lower space to flow to the indoor air inlet 101, thereby an airflow circulation between the upper space and the lower space is formed, the air flowing can be accelerated, more fresh air can be driven to enter the room from the fresh air housing 200, and the airflow replacement efficiency in the room is increased.

A first fresh airflow is blown out from the first fresh air outlet 202, the first fresh airflow can be blown out from the indoor air inlet 101, and then flows back from the indoor air inlet 101 to the indoor heat exchanger 120, and then passes through the indoor heat exchanger 120 to exchange heat and enters the indoor air duct 103 from the indoor heat exchanger 120; or the first fresh airflow can directly enter the indoor heat exchanger 120 from the air inlet side of the indoor heat exchanger 120, and then passes through the indoor heat exchanger 120 to exchange heat and enters the indoor air duct 103. A second fresh airflow directly enters the indoor air duct 103 through the second fresh air outlet 203 and then is mixed evenly with the air for which heat exchange is performed by the indoor heat exchanger 120, and finally is blown out from the indoor air outlet 102. In this process, the second fresh airflow does not pass through the indoor heat exchanger 120.

According to the embodiment of this application, the fresh air housing 200 is mounted in the casing 110 of the window air conditioner 100, the fresh air housing 200 is configured with a fresh air inlet 201, and a first fresh air outlet 202 and a second fresh air outlet 203 in communication with the fresh air inlet 201. The first fresh air outlet 202 is located on an air inlet side of the indoor heat exchanger 120, and the second fresh air outlet 203 is communicated with the indoor air duct 103, so that both the first fresh air outlet 202 and the second fresh air outlet 203 of the fresh air housing 200 are utilized to deliver fresh air. According to this air outlet mode of the fresh air housing 200, an air inlet amount of the fresh air can be greatly increased, and an air outlet effect of the fresh air housing 200 can be improved. Furthermore, an airflow circulation between the upper space and the lower space can be formed (see the foregoing introduction), the airflow is accelerated, more fresh air is driven to enter the room, and airflow replacement efficiency in the room is effectively improved.

Referring to FIG. 4 to FIG. 9, in an embodiment, the fresh air housing 200 includes an air inlet portion 210 provided with the fresh air inlet 201, an air outlet portion 240 located between the indoor heat exchanger 120 and the indoor air inlet 101, and an air guiding portion 220 communicating the air inlet portion 210 and the air outlet portion 240. The fresh air inlet 201 is provided at one end of the air inlet portion 210 away from the air outlet portion 240. The air outlet portion 240 is provided with the first fresh air outlet 202, and the air guiding portion 220 is provided with the second fresh air outlet 203. The first fresh air outlet 202 is formed on a front wall plate 241 of the air outlet portion 240.

In an embodiment, the fresh air housing 200 extends from the outdoor portion 1102 of the casing 110 to the indoor portion 1101 of the casing 110. Since the outdoor heat exchanger 130 is shorter and occupies a smaller space in a length direction of the casing 110 and the indoor heat exchanger 120 is longer and occupies a larger space in the length direction of the casing 110, the air inlet portion 210 of the fresh air housing 200 is disposed at one end of the outdoor heat exchanger 130. The air outlet portion 240 of the fresh air housing 200 passes forward at a lower end of the indoor heat exchanger 120, and the air guiding portion 220 of the fresh air housing 200 is located between the outdoor heat exchanger 130 and the indoor heat exchanger 120. The fresh air inlet 201 is configured at one end of the air inlet portion 210 away from the air outlet portion 240, and the fresh air inlet 201 corresponds to the outdoor air inlet on the back surface of the housing 112. Thus, the outdoor fresh air can directly enter the fresh air inlet 201 from the outdoor air inlet.

Referring to FIG. 6 to FIG. 10, the fresh air housing 200 may be any one of various shapes and structures. For example, the fresh air housing 200 may be in a straight cylindrical shape, or in a tapered shape. In this regard, if the fresh air housing 200 is in a straight cylindrical shape, a ventilation cross section of the fresh air duct 204 inside the fresh air housing 200 along a flowing direction of the airflow is basically constant, and the air pressure gradually decreases as the airflow flows from the outdoors to the indoors, which reduces the air speed of the fresh air and results in a small amount of fresh air.

In this regard, in this embodiment, a ventilation cross section of the air outlet portion 240 of the fresh air housing 200 is made to be smaller than a ventilation cross section of the air inlet portion 210, so that the airflow is compressed in the process of entering the air outlet portion 240 from the air inlet portion 210, the fresh air in the air outlet portion 240 is compressed to increase the air pressure, and the fresh air with higher air pressure rapidly flows to each fresh air outlet and can be promptly blown out from each fresh air outlet with a higher wind speed. The amount of fresh air is thereby increased.

Figure 12:
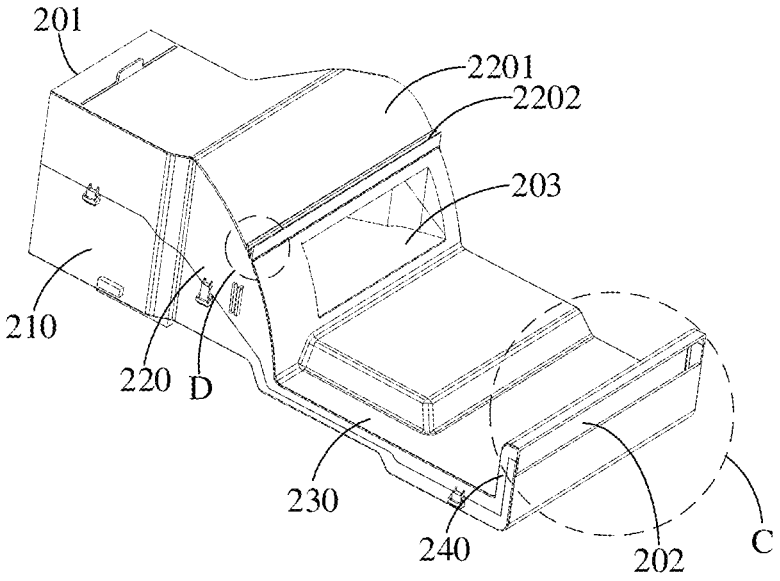
FIG. 12 is a schematic view of the fresh air housing of FIG. 11, viewed from another perspective.
Figure 13:
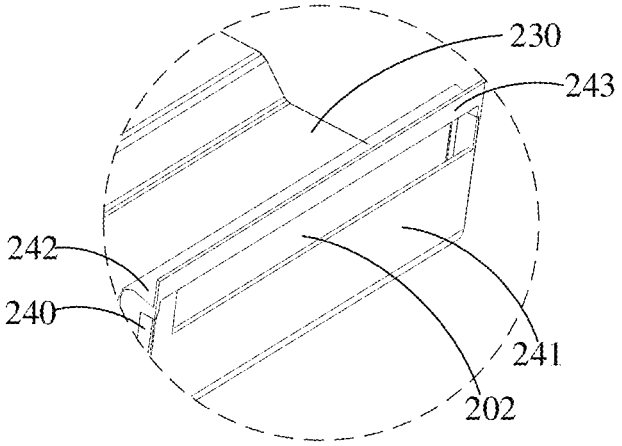
FIG. 13 is an enlarged view of portion C in FIG. 12.

Referring to FIG. 6, FIG. 11 and FIG. 12, in order to facilitate the passage of the air outlet portion 240 below the lower end of the indoor heat exchanger 120, optionally, the fresh air housing 200 further includes an air directing portion 230 in communication with the air guiding portion 220 and the air outlet portion 240. The air directing portion 230 is of a flat shape, the air directing portion 230 is extended from the air guiding portion, passing through the lower end of the indoor heat exchanger 120 and connected to a lower end of the air outlet portion 240, and the first fresh air outlet 202 is formed at an upper end of the air outlet portion 240.

In an embodiment, the air directing portion 230 and the air outlet portion 240 cooperate to form an L shape. The air directing portion 230 directs a portion of the airflow in the air guiding portion 220 to the air outlet portion 240, and then the portion of the airflow flows upward through the air outlet portion 240 to the first fresh air outlet 202. The air directing portion 230 is arranged to be of a flat shape and has a small thickness, thus the air directing portion 230 can be embedded between the chassis 111 of the casing 110 and the bottom of the indoor heat exchanger 120. In this way, the air directing portion 230 may be narrower than the air inlet portion 210, which facilitates increasing the air pressure in the air directing portion 230 and accelerating the airflow to be blown out.

The orientation of the first fresh air outlet 202 may be any one of various orientations. For example, the first fresh air outlet 202 is opened towards the indoor air inlet 101 to directly blow fresh air to the outside of the indoor air inlet 101. For another example, the first fresh air outlet 202 is opened towards the air inlet side of the indoor heat exchanger 120, and the amount of fresh air that flows back from the indoor heat exchanger 120 may be increased. For still another example, the first fresh air outlet 202 is opened upward to blow the airflow to between the indoor heat exchanger 120 and the indoor air inlet, and then the airflow naturally flows to the indoor heat exchanger 120 or the indoor air inlet.

In this embodiment, the first fresh air outlet 202 is opened towards the indoor air inlet 101, and the first fresh air outlet 202 is close to a lower end of the indoor air inlet 101, to prevent suction of the indoor air inlet 101 and a lot of air from being drawn into the interior of the casing 110, thereby ensuring that more airflow blown from the first fresh air outlet 202 is blown to the lower space of the indoors.

Referring to FIG. 6, FIG. 11 and FIG. 12 again, in an embodiment, considering that a ventilation cross section of the air outlet portion 240 is smaller than a ventilation cross section of the air inlet portion 210, if a large change in cross-sectional area takes place between the air inlet portion 210 and the air outlet portion 240 (similar to that the cross-sectional area of the air outlet portion 240 decreases significantly as compared to the cross-sectional area of the air inlet portion 210), a large wind resistance is formed at a position where the great change of cross-sectional area takes place, which is not conducive to the flowing of airflow. Therefore, the air inlet portion 210 may gradually change towards the air outlet portion 240 through the air guiding portion 220, so that the ventilation cross section of the fresh air housing 200 gradually decreases from the air guiding portion 220 to the air outlet portion 240, and the occurrence of a great change of cross-sectional area between the air inlet section and the air outlet portion 240 of the air outlet section is avoided. Thus, the formation of a large wind resistance at this position is also avoided, and the airflow can smoothly enter the air outlet section from the air inlet section.

For the air outlet portion 240 is of a flat shape, the air guiding portion 220 has an air guiding wall 2201 of an arc shape. The air guiding wall 2201 extends downwards from a top wall of the air inlet portion 210 to a top wall of the air outlet portion 240, and the air guiding wall 2201 forms a narrowed opening at a terminal end of the air guiding portion 220. The airflow from the air inlet portion 210 into the air guiding portion 220 is deflected by the air guiding wall 2201 from top to bottom to flow to the narrowed opening, and then enters the air outlet portion 240 through the narrowed opening, and finally is blown out from the air outlet portion 240. In this process, the airflow is gradually compressed to increase the speed of the airflow.

On this basis, the second fresh air outlet 203 is provided on the air guiding wall 2201, so that the fresh airflow can be quickly divided into the indoor air duct 103, and the amount of fresh air of the second fresh air outlet 203 is effectively increased. In other embodiments, the second fresh air outlet 203 may be disposed on the top wall of a horizontal section 231 (for this, an air duct is needed to be form at the water receiving tray above the horizontal section 231).

Further, the air guiding portion 220 is located on a rear side of the indoor wall 160. A mounting opening is formed on a rear wall plate 161 of the indoor wall 160. The second fresh air outlet 203 of the air guiding portion 220 is extended into the interior of the indoor wall 160 from the mounting opening, and communicates with the indoor air duct 103.

Figure 14:
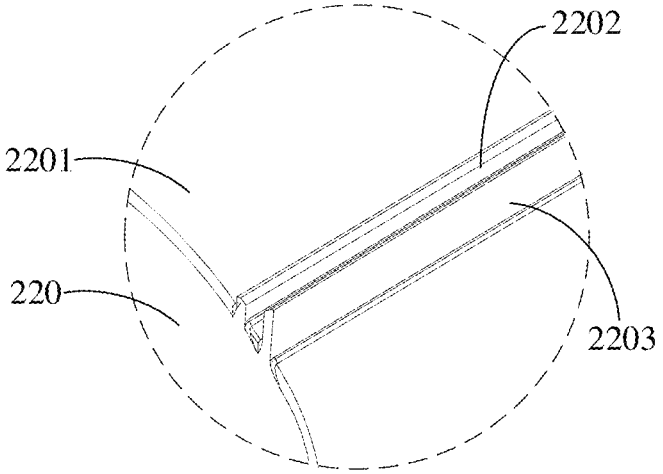
FIG. 14 is an enlarged view of portion D in FIG. 12.

Referring to FIG. 6, FIG. 12 and FIG. 14, optionally, the air guiding wall 2201 of the air guiding portion 220 is provided with a mounting slot 2202 located above the second fresh air outlet 203, and the mounting slot 2202 is extended consistently with the extension direction of an upper side of the second fresh air outlet 203, and the mounting slot 2202 is suitable for insertion of an insertion plate located on the upper side of the mounting opening or located on an upper side edge of the mounting opening. In an embodiment, the air guiding wall 2201 is convexly provided with a mounting protruding strip 2203, and the mounting protruding strip 2203 extends along a length direction of the upper side edge of the second fresh air outlet 203, and the mounting slot 2202 is formed on the mounting protruding strip 2203. During assembling, an upper side of a mounting opening side of the indoor wall 160 may be inserted into the mounting slot 2202, which not only fixes the fresh air housing 200, but also forms a sealing structure to prevent fresh air blown from the second fresh air outlet 203 from leaking upwards. Alternatively, a rear wall 161 of the indoor wall 160 is configured with an insertion plate located on the upper side of the mounting opening, and the insertion plate is inserted into the mounting slot 2202 to form a sealing structure.

Figure 7:
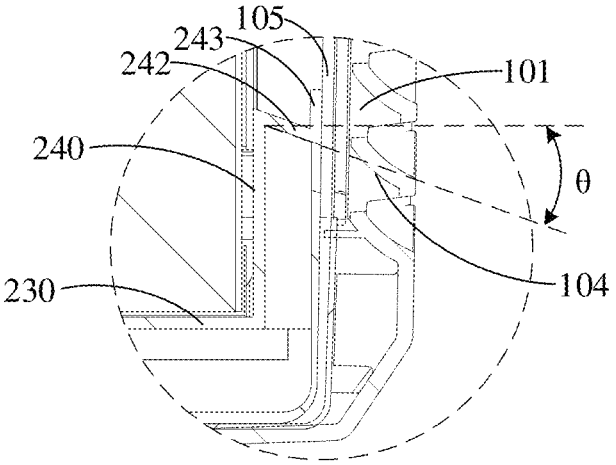
FIG. 7 is an enlarged view of portion A in FIG. 6.

Referring to FIG. 6 and FIG. 7, based on any one of the above embodiments, when the fresh air mode of the window air conditioner 100 is turned on, the fresh air of the outdoors enters the fresh air duct inside the fresh air housing 200 from the fresh air inlet 201, then is blown forward from the first fresh air outlet 202, and the blown fresh air forwards from the lower portion of the indoor air inlet 101 to the indoors, to replenish the fresh air in the lower space of the indoors. Then, the fresh air and the airflow of the indoors is mixed, and flows back through the middle and upper portions of the indoor air inlet 101 and exchanges heat through the indoor heat exchanger 120, and then is blown to the middle and upper spaces of the indoors through the indoor air outlet 102, thereby a fresh airflow circulation is formed between the lower space and the upper space. When the fresh air passes through the indoor heat exchanger 120, not only the temperature of the fresh air can be adjusted, but also the humidity of the fresh air can be adjusted to achieve the dehumidification effect.

Based on this, in order to solve the problem that the fresh air blown from the first fresh air outlet 202 flows back from the air inlet side of the indoor heat exchanger 120 before the fresh air is blown out to the indoors from the first fresh air outlet 202, the window air conditioner 100 further includes a first air guiding member 242, and the first air guiding member 242 is arranged on the first fresh air outlet 202 for guiding the fresh air to blow obliquely downwards into the indoors from the first fresh air outlet 202. That is to say, the fresh air blown out from the first fresh air outlet 202 has a tendency to flow downwards, thus the fresh air blown out from the first fresh air outlet 202 will directly flow downwards from a lower end of the indoor air outlet to the indoors and not easily flow upwards to the air inlet side of the indoor heat exchanger 120, so that the fresh air is not easy to return directly from the indoor heat exchanger 120 to the interior of the window air conditioner, and the fresh air housing 200 can provide sufficient amount of fresh air to the indoors in time.

In the above embodiment, the fresh air housing 200 is mounted in the casing 110 of the window air conditioner 100, the fresh air housing 200 is provided with the fresh air inlet 201 and the first fresh air outlet 202, the fresh air inlet 201 is communicated with the outdoors, and the first fresh air outlet 202 is located between the indoor heat exchanger 120 and the indoor air inlet 101, thus, the fresh air can be directly sent to the indoors through the first fresh air outlet 202. Moreover, the first air guiding member 242 is provided at the first fresh air outlet 202, so that when the fresh air is conveyed to the indoors through the first fresh air outlet 202, the fresh air is prevented from flowing upwards to the air inlet side of the indoor heat exchanger 120, thus the fresh air is prevented from flowing back to the interior of the window air conditioner directly from the indoor heat exchanger, and the fresh air housing 200 can provide sufficient amount of fresh air to the indoors in time.

The first air guiding member 242 may be any one of various shapes and structures. For example, but it is not limited to that, the first air guiding member 242 is an air guiding plate inclined from a rear side to a front side thereof, or the first air guiding member 242 is an air guiding flange inclined downward from the upper edge of the first fresh air outlet 202, or the first air guiding member 242 is a wind guiding cylinder inclined downward from a periphery of the first fresh air outlet 202. The details of those structures are given below.

Referring to FIGS. 6 and 7 and FIGS. 12 and 13, further, the first air guiding member 242 can be in the form of an upper wall plate 242 located at a top of the air outlet portion 240. A front edge of the upper wall plate 242 forms the upper edge of the first fresh air outlet 202. A surface of the upper wall plate 242 is inclined downwards from a rear side to a front side thereof, to form the first air guiding member 242. When the fresh air flows from bottom to top along the air outlet portion 240 to the top end of the air outlet portion 240, the fresh air is guided by the upper wall plate 242 of the air outlet portion 240 to obliquely flow downwards, so as to be deviated downward from the first fresh air outlet 202 to the indoors.

Referring to FIG. 6 and FIG. 7, in an embodiment, the indoor air inlet 101 is further provided with a plurality of air inlet louvers 104 arranged at intervals in an up-down direction. Air inlet louvers 104 located at the lower end of the indoor air inlet 101 corresponds to the first fresh air outlet 202, and surfaces of those air inlet louvers 104 incline downwards from a rear side to a front side thereof.

In this embodiment, surfaces of a plurality of air inlet louvers 104 are inclined forward and downward, and a louver gap is formed between any two air inlet louvers 104 or between an air inlet louver 104 and a side edge of the indoor air inlet 101. A louver gap between the lowermost air inlet louver 104 and the lower edge of the indoor air inlet 101 is formed to communicate the first fresh air outlet 202 with the indoors.

During the operation of the window air conditioner 100, the airflow of the indoors obliquely enters the interior of the window air conditioner 100 from louver gaps at middle and upper portions of the indoor air inlet 101, and the fresh air blown out downwards through the first fresh air outlet 202 of the fresh air housing 200 enters the indoors through the louver gaps located at the lowermost end of the indoor air inlet 101. In this process, for the surfaces of the air inlet louvers 104 corresponding to the first fresh air outlet 202 incline downwards from the rear side to the front side thereof, the fresh air, which is guided by the first air guiding member 242 at the first fresh air outlet 202 and blown out downwards, is further guided by the air inlet louvers 104 to flow downwards, thus the fresh air is not easy to diffuse in the blowing process, the directional bias downward blowing is achieved, and it ensures that the fresh air can be blown to the indoors.

Referring to FIG. 6 and FIG. 7, in an embodiment, a rear edge of at least one air inlet louver 104 corresponds to the front edge of the upper wall plate 242 of the air outlet portion 240, and an inclination angle of the air inlet louver 104 is consistent with or inconsistent with an inclination angle of the upper wall plate 242, as along as air guiding directions of the two are the same. Optionally in this embodiment, the rear edge of at least one air inlet louver 104 corresponds to the front edge of the upper wall plate 242 of the air outlet portion 240, and the inclination angle of the air inlet louver 104 is consistent with the inclination angle of the upper wall plate 242. Both configurations can effectively extend the air guiding path guiding the fresh air to slant down.

The inclination angle of the upper wall plate 242 of the air outlet portion 240 is not specifically limited herein. Optionally, an included angle between a surface of the upper wall plate 242 of the air outlet portion 240 and a horizontal plane is at least 15° and does not exceed 60°. In FIG. 3, θ is the included angle between the surface of the upper wall plate 242 of the air outlet portion 240 and the horizontal plane. The θ may be, but is not limited to, 16°, 20°, 25°, 30°, 35°, 40°, 45°, 50°, 55°, 60°, or the like. If the θ0 is less than 30°, the inclination of the upper wall plate 242 is slight, and the flow guiding effect of the upper wall plate 242 is not obvious. If the θ is greater than 60°, the inclination of the upper wall plate 242 is large, and the upper wall plate 242 may limit the air outlet surface of the first fresh air outlet, resulting in a reduction of the amount of the fresh air. Thus, the included angle is preferably to be at least 15° and not more than 60°.

Figure 9:
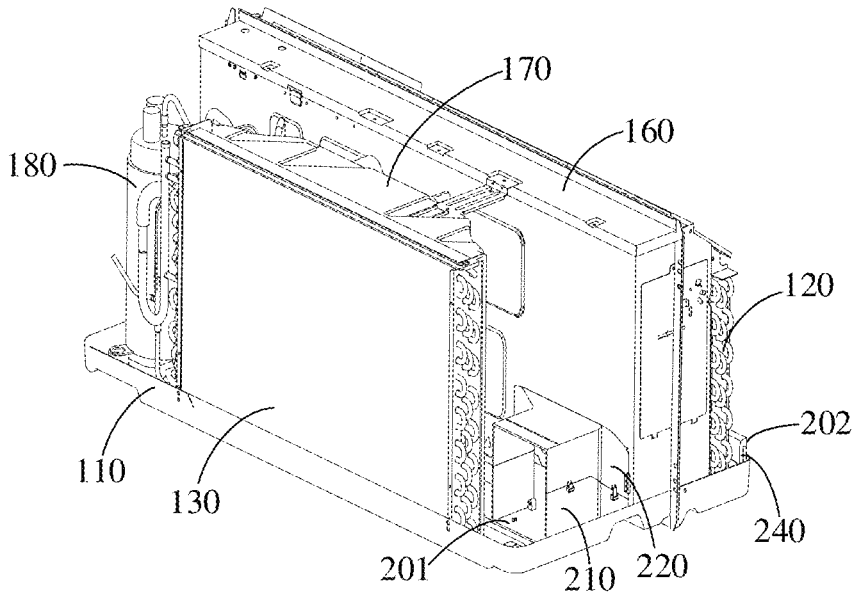
FIG. 9 is a schematic view of the window air conditioner in FIG. 4, viewed from another perspective.
Figure 10:
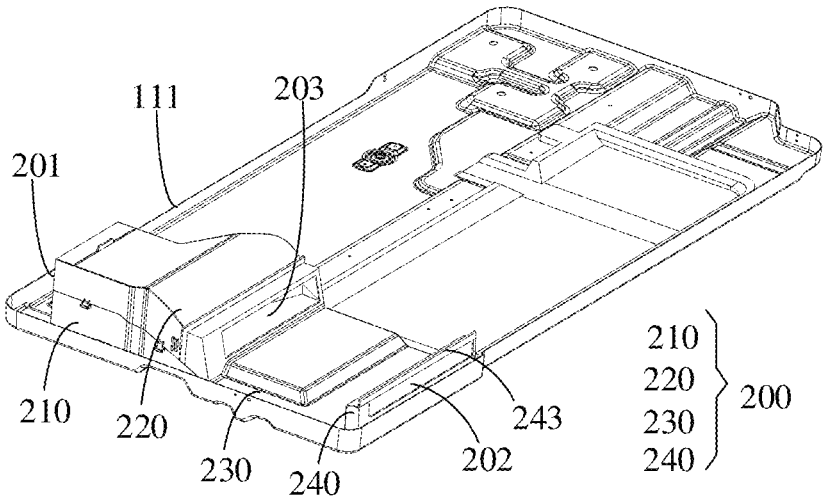
FIG. 10 is an assembled view of a chassis and a fresh air housing of the window air conditioner of FIG. 9.

Referring also to FIG. 6 and FIG. 7, in an embodiment, the fresh air housing 200 further includes a wind deflector 243 configured on the air outlet portion 240, and the wind deflector 243 is located at or near the upper edge of the first fresh air outlet 202 and extends along the length direction of the upper edge of the first fresh air outlet 202 (as shown in FIG. 9 and FIG. 10). Optionally, the wind deflector 243 is close to the upper edge of the first fresh air outlet 202, so that the fresh air, which is blown out from the first fresh air outlet 202 and has a flow back tendency, will immediately be blocked by the wind deflector 243 and cannot flow back. Thus, the direct backflow to the air inlet side of the indoor heat exchanger 120 is avoided, and fresh air blown out by the first fresh air outlet 202 can only blow forward to the indoors to replenish the fresh air in the lower space of the indoors.

In an embodiment, the window air conditioner 100 further includes an air inlet filter screen 105 disposed between the indoor heat exchanger 120 and the indoor air inlet 101. The wind deflector 243 is located behind the air inlet filter screen 105, and a front surface of the wind deflector 243 abuts against a rear surface of the air inlet filter screen 105. Therefore, there is no gap formed between the wind deflector 243 and the air inlet filter screen 105, and the fresh air blown out from the first fresh air outlet 202 can be discouraged from returning upward from between the air inlet filter screen 105 and the wind deflector 243, so that the fresh air can only be blown out from the air inlet filter screen 105 and blown into the indoors, and is purified and filtered in this process. Then, when the fresh air is mixed with the indoor air, the fresh air enters the indoor air duct 103 again from the air inlet filter screen 105 when the fresh air flows back from the upper portion of the indoor air inlet. In this process, the fresh air is purified and filtered again, and the fresh air purification efficiency is improved.

Figure 8:
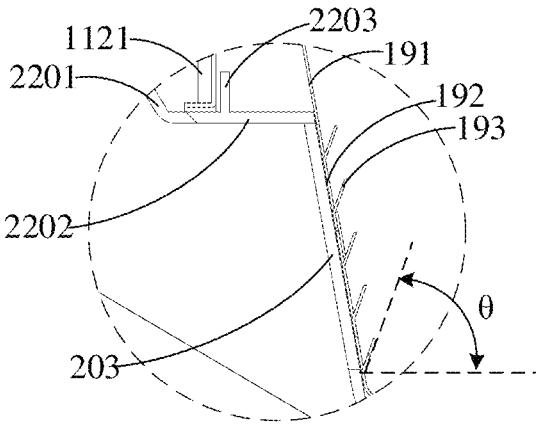
FIG. 8 is an enlarged view of portion B in FIG. 6.

Referring to FIG. 6 and FIG. 8, based on any one of the above embodiments, the window air conditioner 100 further includes an air duct housing 190. The air duct housing 190 is arranged in the indoor wall 160 to form the indoor air duct 103. An air supply port 192 is formed on the air duct housing 190, and the air supply port 192 communicates the second fresh air outlet 203 with the indoor air duct 103.

When the fresh air mode of the window air conditioner 100 is turned on, a portion of the fresh air introduced from the fresh air housing 200 is blown out from the second fresh air outlet 203 of the air guiding portion 220, and then is blown to the middle and upper spaces of the indoors through the indoor air duct 103, the indoor fan 140 and the indoor air outlet 102, and the other portion is blown out from the air guiding portion 220 to the air outlet portion 240, and finally is blown downwards from the first fresh air outlet 202 to the lower space of the indoors through the indoor air inlet 101. In this way, fresh air is provided to the upper, middle and lower spaces of the indoor space, and the distribution of the fresh air in the indoors is improved. Moreover, after the airflow (which is blown from the first fresh air outlet 202) is mixed with the airflow, for which heat exchange has been conducted, and then blown out from the indoor air outlet, the airflow of the lower space is pushed to flow to the indoor air inlet 101. Thus, airflow circulation is formed between the upper space and the lower space, the airflow can be accelerated, more fresh air can be driven to enter the indoors from the fresh air housing 200, and the indoors airflow replacement efficiency is increased.

Considering that the fresh air introduced from the air supply port 192 may collide with the airflow blown from the air outlet side of the indoor heat exchanger 120, the indoor air circulation amount of the indoor air inlet 101 and the amount of the fresh air introduced by the air supply port 192 are both reduced, which causes the reduction of air volume. In order to avoid this, optionally, the window air conditioner 100 further includes a second air guiding member 193 disposed at the air supply port 192, and the second air guiding member 193 is adapted to guide air to the indoor fan 140.

By providing the second air guiding member 193 at the air supply port 192, when the fresh air housing 200 conveys fresh air to the indoor air duct 103, the fresh air is guided upwards to the air inlet side of the indoor fan 140 by the second air guiding member 193, and the flowing direction of the fresh air is consistent with a flowing direction of a heat exchange airflow from the air outlet side of the indoor heat exchanger 120 to the indoor fan 140, the situation that the fresh air colliding with the heat exchange airflow is thus avoided, the resistance of fresh airflow is reduced, a large amount of fresh air can be blown out of the indoor air outlet 102 through the indoor fan 140, and the air outlet amount of the window air conditioner is effectively increased. As the indoor fan 140 rotates, the indoor fan 140 drives the fresh air and the heat exchange airflow to mix, thereby mixed air with a relatively comfortable temperature is obtained, and the mixed air is finally driven by the indoor fan 140 to be blown out from the indoor air outlet 102 to the indoors.

The second air guiding member 193 may be any one of various shapes and structures. For example, but it is not limited to that, the second air guiding member 193 is an air guiding plate of a strip shape, or the second air guiding member 193 is an air guide flange extending from the lower edge of the second fresh air outlet 203 or of the air supply port 192 to the air inlet side of the indoor fan 140, or the second air guiding member 193 is an air guide cylinder extending from a periphery of the second fresh air outlet 203 or of the air supply port 192 to the air inlet side of the indoor fan 140, the details of those structures are given below.

As described above, the second air guiding member 193 is disposed at the air supply port 192. The second air guiding member 193 may be fixedly connected to an air duct back plate 191, or may be integrally formed with the air duct back plate 191, and in this embodiment, the later manner is adopted.

Referring to FIGS. 6 and 8, and FIGS. 17 and 18, in an embodiment, the air inlet surface of the indoor heat exchanger 120 corresponds to the indoor air inlet 101. The air duct housing 190 includes the air duct back plate 191 corresponding to the air outlet side of the indoor heat exchanger 120, and the air supply port 192 is formed on the air duct back plate 191, so that the airflow blown from the air supply port 192 is located on the air inlet side of the indoor fan 140. Moreover, the second air guiding member 193 is disposed at the air supply port 192 and is fixedly connected to the air duct back plate 191.

As for the structure of the second air guiding member 193, optionally, the second air guiding member 193 is an air guiding plate 193 disposed in the air supply port 192, and a surface of the air guiding plate 193 is inclined towards the indoor fan 140 from a lower edge to an upper edge thereof. The air guiding plate is of a strip shape and extends in a left-right direction of the air duct housing 190. The lower side of the air guiding plate 193 is deviated downward and is close to the second fresh air outlet 203 of the fresh air housing 200, and the upper side of the air guiding plate 193 is deviated upward and faces the indoor fan 140. Thus, when the second fresh air outlet 203 blows the fresh air to the air supply port 192, the fresh air is directed by the air guiding plate 193 to blow to the indoor fan 140, so that a large amount of fresh air cannot blow to the indoor heat exchanger 120, and is prevented from colliding with the airflow passed through the indoor heat exchanger 120 and affecting the air inlet amount of the indoor air inlet 101, and it is ensured that a large amount of air enters from the indoor air inlet 101 for heat exchange or dehumidification, which facilitates increasing the air volume and improve the dehumidification effect.

In other embodiments, the second air guiding member 193 may be an air guiding cylinder protruding from an inner periphery of the air supply port 192, and an outlet of the air guiding cylinder faces the indoor fan 140. The air guiding cylinder surrounds an periphery of the air supply port 192, after the fresh air is blown to the air supply port 192 from the second fresh air outlet 203, the fresh air enters the air guiding cylinder, and then flows from the air guiding cylinder to the indoor fan 140 (which is analogous to a chimney for guiding smoke) through the outlet of the air guide cylinder, so that a large amount of fresh air cannot blow to the indoor heat exchanger 120 to collide with the airflow passed through the indoor heat exchanger and affect the air inlet amount of the indoor air inlet 101.

Figure 17:
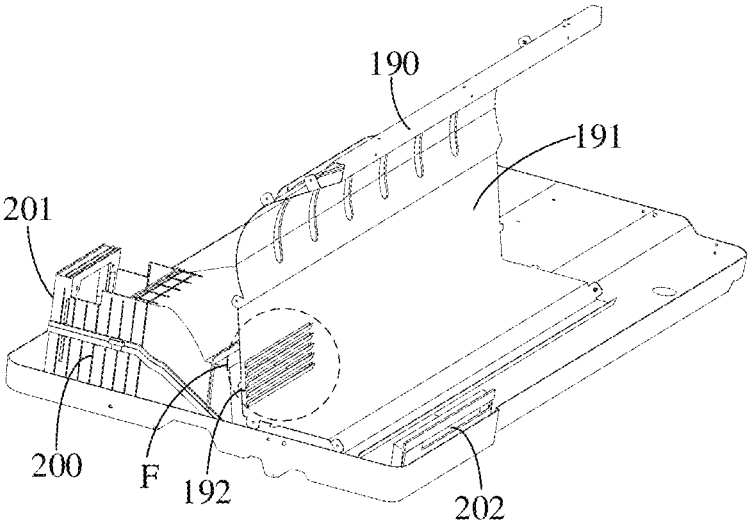
FIG. 17 is an assembled view of the chassis, the fresh air housing and an air duct housing of the window air conditioner of FIG. 9.
Figure 18:
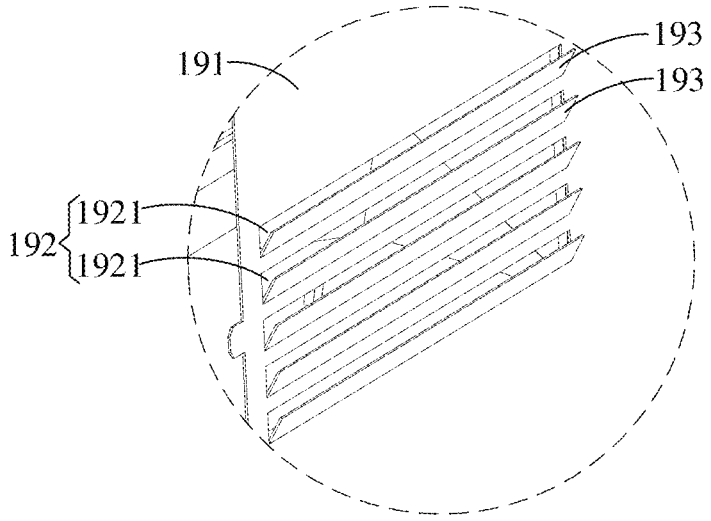
FIG. 18 is an enlarged view of portion F in FIG. 17.

Referring to FIG. 17 and FIG. 18, in this embodiment, the second air guiding member 193 comprises a plurality of air guiding plates 193 disposed in the air supply port 192. The plurality of air guiding plates 193 are arranged at intervals along an up-down direction of the air supply port 192, and inclined directions of surfaces of the plurality of air guiding plates 193 are consistent. A ventilation gap is formed between every two adjacent air guiding plates 193. The plurality of air guiding plates 193 cooperate to guide a large amount of fresh air to the air inlet side of the indoor fan 140.

Figure 4:
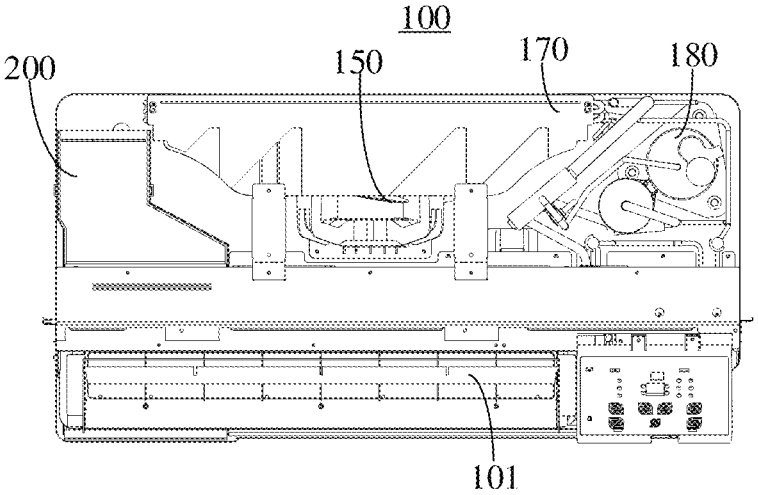
FIG. 4 is a top view of the window air conditioner of FIG. 1, with the housing removed.
Figure 5:
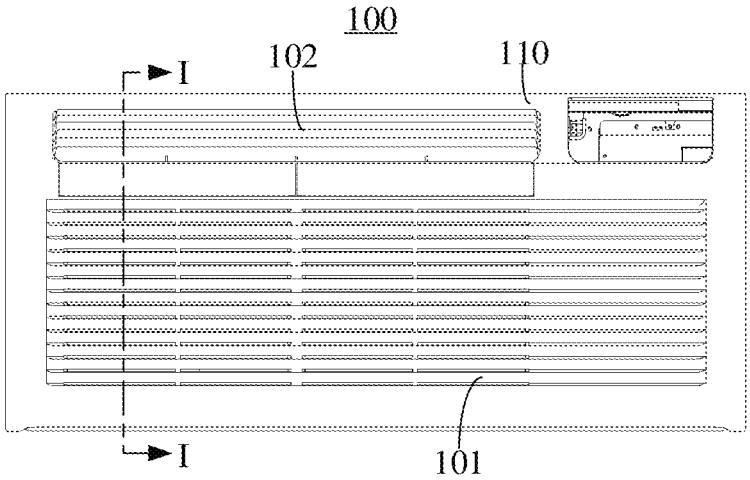
FIG. 5 is a front view of the window air conditioner of FIG. 1.

An inclination angle of each air guiding plate 193 may be set according to the relative positions between the air supply port 192 and the indoor fan 140 which is not specifically limited herein. Optionally, an included angle between a surface of each air guiding plate 193 and the horizontal plane is at least 30° and does not exceed 75°. As shown in FIG. 4, θ is the included angle formed between the surface of each air guiding plate 193 and the horizontal plane. The angle θ may be, but is not limited to, 30°, 35°, 40°, 45°, 50°, 55°, 60°, 65°, 70°, or the like. If the angle θ is less than 30°, the inclination of each air guiding plate 193 is slight, and the flow guiding effect of each air guiding plate 193 is not obvious. If the angle θ is greater than 60°, the inclination of each air guiding plate 193 is large, and a portion of the airflow may be guided to an inner surface of the air duct back plate 191, and is not easy to enter the indoor fan 140. Thus, the included angle is preferably to be at least 30° and not more than 75°.

The air supply port 192 may be a large opening, or be composed of a plurality of strip-shaped ventilation holes 1921 distributed along the up-down direction. In this embodiment, the air supply port 192 is composed of a plurality of strip-shaped ventilation holes 1921 arranged along the up-down direction. Accordingly, the plurality of air guiding plates 193 correspond to the plurality of strip-shaped ventilation holes 1921 one to one, and a lower side of each air guiding plate 193 is connected to a lower edge of a corresponding strip-shaped ventilation hole 1921.

In an embodiment, the lower edge of each air guiding plate 193 and the lower edge of the corresponding strip-shaped ventilation hole 1921 are tightly connected, so that there is no air leakage gap formed between the lower side of each air guiding plate 193 and the lower edge of the corresponding strip-shaped ventilation hole 1921, and the fresh air airflow can only be blown out from the upper side of each air guiding plate 193. In addition, since each air guiding plate 193 is inclined, the fresh air cannot flow downward or forward, and only can be deviated upwards along the air guiding plate 193 to the air inlet side of the indoor fan 140, the colliding between the fresh air and the airflow passed through the indoor heat exchanger is effectively avoided, and the indoor heat exchanger having a large air volume is ensured.

In order to facilitate the manufacturing of the air guiding plate 193, an inverted U-shaped slit may be provided on the air duct back plate 191, and then a portion enclosed by the inverted U-shaped slit is bent toward the indoor air duct for a tilt angle to form a flange, and the flange forms an air guiding plate 193. In other embodiments, ends of each air guiding plate 193 is fixedly connected to two sides of the air supply port 192.

Figure 15:
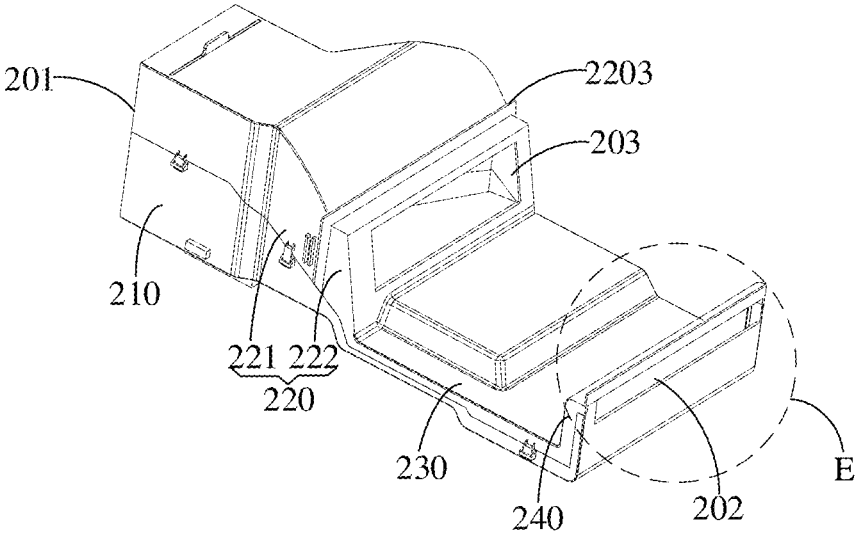
FIG. 15 is a schematic structural view of the fresh air housing of the window air conditioner according to another embodiment of this application.
Figure 16:
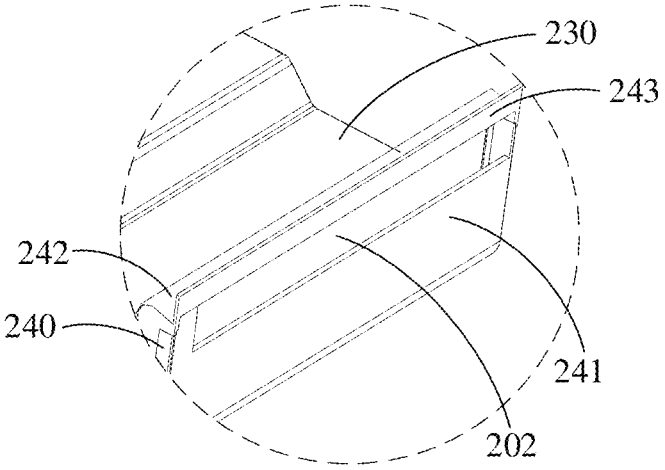
FIG. 16 is an enlarged view of portion E in FIG. 15.

Referring to FIG. 15, FIG. 16 and FIG. 17, in an embodiment, the air guiding portion 220 includes a first air guiding section 221 connected to the air inlet portion 210 and a second air guiding section 222 extending forward from the first air guiding section 221. A top wall of the first air guiding section 221 is inclined downward from the air inlet portion 210, and a terminal end of the first air guiding section 221 forms a narrowed opening. The second air guiding section 222 has a front wall corresponding to the narrowed opening, and the second fresh air outlet 203 is formed on the front wall.

When the airflow enters the air guiding portion 220 from the air inlet portion 210, the airflow guided by the top wall of the first air guiding section 221 to flow downward to the narrowed opening. The airflow is compressed at the narrowed opening to increase the air pressure. Due to that the second fresh air outlet 203 of the second air guiding section 222 faces the narrowed opening of the first air guiding section 221, the airflow quickly flows from the narrowed opening to the second fresh air outlet 203, so that the fresh air is blown out from the second fresh air outlet 203 with a larger speed, and the amount of the fresh air is effectively increased.

Referring to FIG. 15, FIG. 17 and FIG. 18, in an embodiment, the indoor housing 1121 has a housing back plate 1123 located behind the air duct back plate 191. The second air guiding section 222 passes through the housing back plate 1123 to extend the second fresh air outlet 203 to the air supply port 192 of the air duct back plate 191. That is, the second fresh air outlet 203 is directly docked with the air supply port 192 on the air duct back plate 191, so that the airflow blown from the second fresh air outlet 203 can directly enter the indoor air duct 103 from the air supply port 192, the fresh air path is shortened, and air leakage in the fresh air passage process is avoided.

Further, a mounting notch allowing the second air guiding section 222 to pass through is formed in a lower end of the housing back plate 1123 of the indoor housing 1121. A baffle 223 is convexly arranged on an outer periphery of the second air guiding section 222, and the baffle 223 is extended from one side wall of the second air guiding section 222 to the other opposite side wall of the second air guiding section 222, and passes through a top wall of the second air guiding section 222 before reaching the opposite side wall, so as to be suitable for abutting against an inner edge of the mounting notch.

In an embodiment, the mounting notch of the indoor housing 1121 penetrates through a lower edge of the housing back plate 1123. During assembling, the fresh air housing 200 and the air duct housing 190 are firstly mounted on the chassis 111, and then the indoor housing 1121 is covered on the air duct housing 190. In this process, the mounting notch of the indoor housing 1121 is aligned with the fresh air housing 200, and the second air guiding section 222 of the fresh air housing 200 passes through the mounting notch. After being assembled, the baffle 223 on the second air guiding section 222 is located between the housing back plate 1123 and the air duct back plate 191 of the indoor housing 1121, and the baffle 223 abuts against the inner edge of the mounting notch, which not only prevents the fresh air housing 200 from moving toward the outdoors, and prevents the second fresh air outlet 203 from being disengaged from the air supply port 192, but also seals the gap between the second air guiding section 222 and a periphery of the mounting notch to avoid air leakage.

Figure 20:
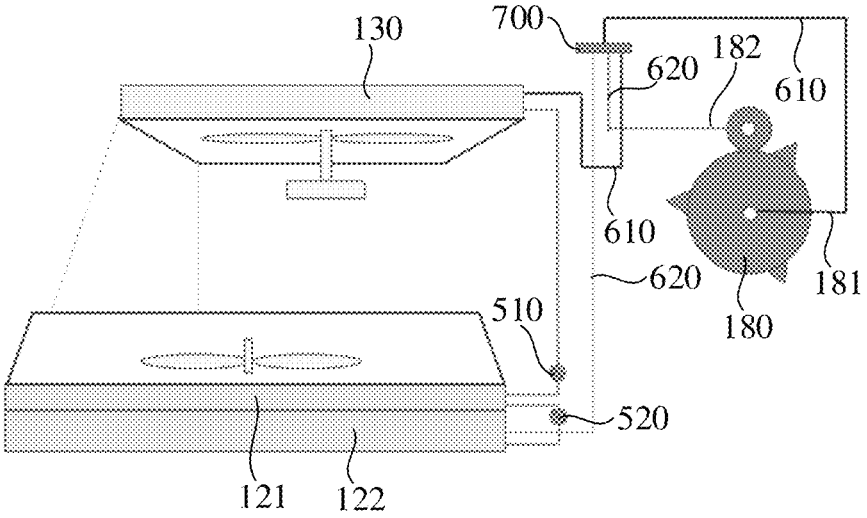
FIG. 20 is a schematic diagram showing an operative principle of the window air conditioner according to another embodiment of this application.
Figure 21:
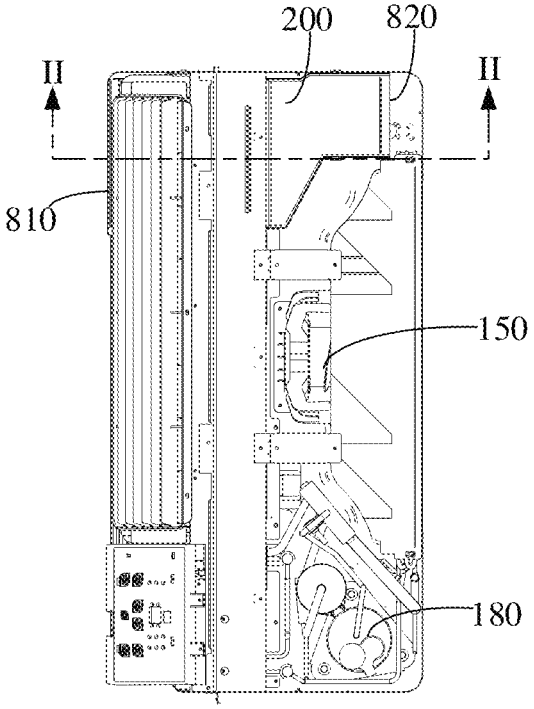
FIG. 21 is a schematic structural view of the window air conditioner according to still another embodiment of this application.
Figure 22:
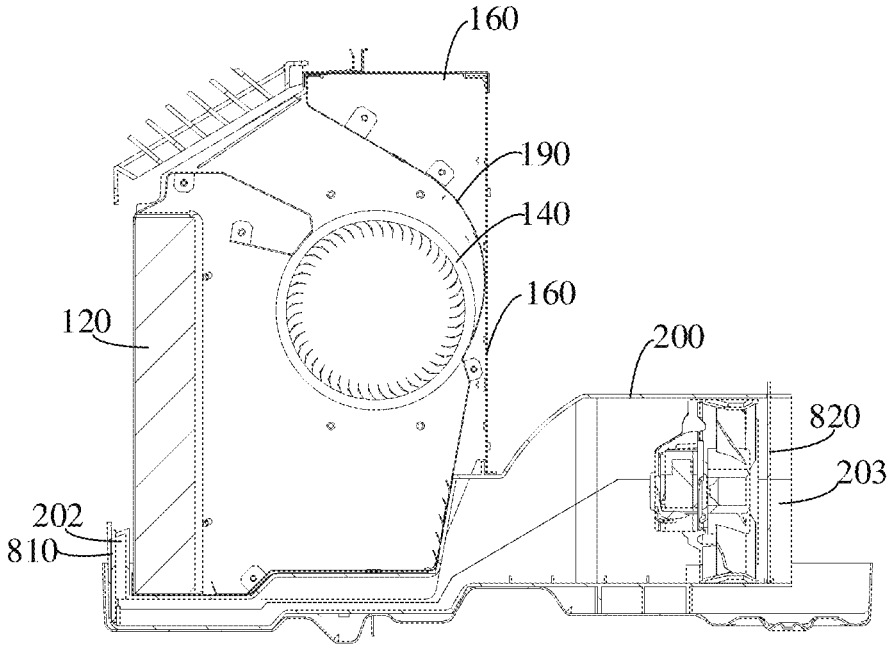
FIG. 22 is a cross-sectional view taken along lines II-II in FIG. 21.

Referring to FIG. 20 and FIG. 21, based on any one of the above embodiments, considering that the first fresh air outlet 202 and the second fresh air outlet 203 are not necessary, optionally, the window air conditioner 100 further includes a first air door 810 configured at the first fresh air outlet 202, and the first air door 810 is movable relative to the first fresh air outlet 202 to open or close the first fresh air outlet 202; and/or the window air conditioner 100 further includes a second air door 820 configured at the second fresh air outlet 203, and the second air door 820 is movable relative to the second fresh air outlet 203 to open or close the second fresh air outlet 203.

It can be understood that the user can choose to open or close the first fresh air outlet 202 through the first air door 810, and can choose to open or close the second fresh air outlet 203 through the second air door 820. For example, the first fresh air outlet 202 is opened and the second fresh air outlet 203 is closed, so that only the first fresh air outlet 202 conveys fresh air, and the amount of fresh air conveyed to the lower space is increased, or the first fresh air outlet 202 is closed, the second fresh air outlet 203 is opened, so that only the second fresh air outlet 203 conveys fresh air, and the amount of fresh air conveyed to the middle and upper spaces is increased.

Referring to FIG. 6, based on any one of the above embodiments, the window air conditioner 100 further includes a fresh air fan 300. The fresh air fan 300 is mounted in the fresh air housing 200 and located between the fresh air inlet 201 and the second fresh air outlet 203. The fresh air fan 300 is configured to drive fresh air of the outdoors to enter from the fresh air inlet 201, and then to be blown out from the first fresh air outlet 202 and/or from the second fresh air outlet 203. The indoor fan 140 can not only drive indoor air to enter the indoor air duct 103 from the indoor air inlet 101, but also drive fresh air of the outdoors to enter the indoor air duct 103 through the second fresh air outlet 203 of the fresh air housing 200. That is, the airflow in the fresh air housing 200 may be driven by both the fresh air fan 300 and the indoor fan 140, and the driving force is strong, and more fresh air can be effectively driven to enter the indoors.

Considering that the fresh air introduced by the fresh air housing 200 may carry air pollutants such as dust, fine particulate matter, bacteria, volatile organic matter gas (such as formaldehyde) when the air quality of the outdoor environment is poor, and it is not conducive to human health, in this regard, the window air conditioner 100 further includes a filter 400 mounted in the fresh air housing 200. The fresh airflow passes through the filter 400 and is filtered and purified by the filter 400, the pollutants in the fresh airflow are removed, and the fresh airflow is purified into clean air to protect human health.

For a specific installation position of the filter 400 in the fresh air housing 200, the filter 400 may be located between the fresh air inlet 201 and the fresh air fan 300, thereby the fresh airflow is first purified by the filter 400, and then passes from the fresh air fan 300 to prevent the fresh air fan 300 from being contaminated. In addition, the filter 400 may be disposed between the fresh air fan 300 and the second fresh air outlet 203. With regard to a structure of the filter 400, the filter 400 may be any one of a conventional filter screen, a PM2.5 filter screen, a volatile organic gas adsorption module, and the like or any combinations thereof. A plurality of filters may be adopted, and the plurality of filters are arranged along a flowing direction of airflow in the fresh air housing. Since the airflow in the fresh air housing 200 can be driven by the fresh air fan 300 and the indoor fan 140 simultaneously, the driving force is strong, and therefore, even if the number of the filters 400 is large, it is ensured that the fresh air housing 200 can deliver a sufficient amount of fresh air which can counteract the wind shielding effect of the filters 400.

Figure 19:
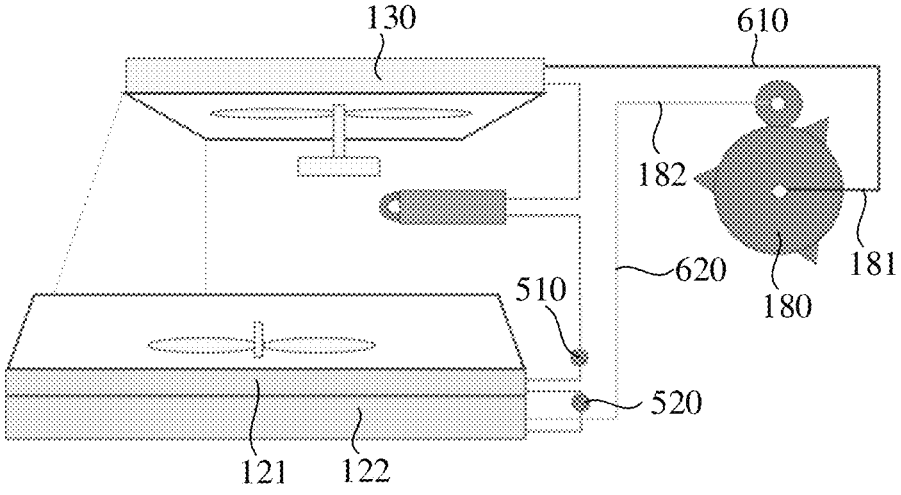
FIG. 19 is a schematic diagram showing an operative principle of the window air conditioner according to an embodiment of this application.

Referring to FIG. 2 and FIG. 19, based on any one of the above embodiments, the window air conditioner is provided with an indoor air inlet 101 on the front surface of the housing 112, and the front surface of the housing 112 should refer to the surface of the window air conditioner facing the user. The indoor heat exchanger 120 of the window air conditioner includes a first indoor heat exchanger 121 and a second indoor heat exchanger 122. The window air conditioner has a constant-temperature dehumidification mode. In the constant-temperature dehumidification mode, one of the first indoor heat exchanger 121 and the second indoor heat exchanger 122 is in a heating mode, and the other is in a cooling mode.

In this embodiment, for the indoor heat exchanger 120 has a first indoor heat exchanger 121 and a second indoor heat exchanger 122, and in the constant-temperature dehumidification mode, one of the first indoor heat exchanger 121 and the second indoor heat exchanger 122 is in the heating mode, and the other is in the cooling mode, the airflow passing through the indoor heat exchanger 120 can be heated and dehumidified. The temperature of the mixed air after heating and dehumidification is suitable, and does not give a cold wind feeling. Not only all indoor air and all fresh air are dehumidified after reciprocating circulation, but also the indoor temperature of the window air conditioner is not decreased in the dehumidification mode, and the purpose of constant-temperature and dehumidification of the whole room can be achieved. Meanwhile, the indoor heat exchanger 120 can be fully utilized during dehumidification, and a fresh air condenser and a fresh air evaporator are not needed, thus the manufacturing cost is greatly reduced.

Referring to FIGS. 2 and 19, in an embodiment, the first indoor heat exchanger 121 and the second indoor heat exchanger 122 are stacked along an air inlet direction of the indoor air duct 103. When the first indoor heat exchanger 121 and the second indoor heat exchanger 122 are stacked along the air inlet direction of the indoor air duct 103, the indoor air or fresh air entering from the indoor air inlet 101 is firstly dehumidified/heated by the first indoor heat exchanger 121, then heated/dehumidified by the second indoor heat exchanger 122, and the indoor fan sends the heated and dehumidified airflow to the indoors from the indoor air outlet, to realize the constant-temperature and dehumidification of the whole room. For the first indoor heat exchanger 121 and the second indoor heat exchanger 122 are stacked along the air inlet direction, the whole of the airflow blown from the indoor air inlet 101 can be heated, and then dehumidified, and the whole of the airflow does not need to be divided into two portions respectively corresponding to heating and dehumidification. Thus, a mixing step is avoided, and the temperature and humidity of the airflow blown from the indoor air outlet are more uniform and comfortable.

Referring to FIG. 2 and FIG. 20, in another implementation, the first indoor heat exchanger 121 and the second indoor heat exchanger 122 are arranged side by side in a direction perpendicular to the air inlet direction of the indoor air duct 103, thus a portion of the airflow entering from the indoor air inlet 101 is blown to the first indoor heat exchanger 121, and the other portion of the airflow entering from the indoor air inlet 101 is blown to the second indoor heat exchanger 122.

In this embodiment, the air inlet direction of the indoor air inlet 101 is generally a front-back direction, and directions perpendicular to the air inlet direction of the indoor air inlet 101 may be a left-right direction and the up-down direction. In this way, the first indoor heat exchanger 121 and the second indoor heat exchanger 122 may be distributed along the up-down direction or along the left-right direction. A portion of the fresh air or indoor air entered from the indoor air inlet 101 is heated/dehumidified through the first indoor heat exchanger 121, and the other portion of the fresh air or indoor air entered from the indoor air inlet 101 is dehumidified/heated by the second indoor heat exchanger 122, and then both portions are mixed in the indoor air duct 103 to form a drying airflow with a suitable temperature, and then the constant-temperature drying airflow is fed into the indoors from the indoor air outlet through the indoor fan, thereby realizing the constant-temperature and dehumidification of the whole room. When the first indoor heat exchanger 121 and the second indoor heat exchanger 122 are distributed along the up-down direction, a single indoor heat exchanger can be adopted, an upper portion of the single indoor heat exchanger forms the first indoor heat exchanger 121, and a lower portion of the single indoor heat exchanger forms the second indoor heat exchanger 122. One of the upper heat exchanger and the lower heat exchanger is controlled to be in a heating state, and the other of the upper heat exchanger and the lower heat exchanger is controlled to be in a cooling state through a control valve. In this way, the space occupied by the indoor heat exchanger 120 can be greatly reduced, the overall structure is more compact, and the size of the whole machine is smaller. By arranging the first indoor heat exchanger 121 and the second indoor heat exchanger 122 up and down or left and right, a thickness of the indoor heat exchanger 120 can be greatly reduced, and the space along the height direction of the housing 112 is fully utilized. Thus, the space occupied by the indoor heat exchanger 120 is reduced, and the volume and weight of the whole machine are reduced.

Referring to FIG. 2 and FIG. 20, in an embodiment, the window air conditioner further includes the outdoor heat exchanger 130, a refrigerant circulation pipeline, a first valve 510 and a second valve 520. A refrigerant outlet of a compressor 180 of the window air conditioner is provided with an exhaust pipe 181, and a refrigerant inlet of the compressor 180 is provided with a suction pipe 182. The exhaust pipe 181, the outdoor heat exchanger 130, the first indoor heat exchanger 121, the second indoor heat exchanger 122, and the suction pipe 182 are connected in series by the refrigerant circulation pipeline. The first valve 510 is installed on the refrigerant circulation pipeline and located between the outdoor heat exchanger 130 and the first indoor heat exchanger 121, and the second valve 520 is installed on the refrigerant circulation pipeline and located between the first indoor heat exchanger 121 and the second indoor heat exchanger 122.

In this embodiment, the compressor 180 may be a variable-frequency compressor 180 or a fixed-frequency compressor 180. When the compressor 180 is a variable-frequency compressor 180, the cooling and constant-temperature dehumidification dual-system can be better realized, and a compressor 180 is saved. Thus, the overall structure is simpler, the cost and power are both reduced, and the energy efficiency is greatly improved. The first valve 510 and the second valve 520 may be electromagnetic valves, electronic expansion valves or throttle valves, and can control the on-off or flow of the pipe where they are located. By providing the first valve 510 and the second valve 520, whether the refrigerant flows into the first indoor heat exchanger 121 and the second indoor heat exchanger 122 can be controlled, and thereby whether the first indoor heat exchanger 121 and the second indoor heat exchanger 122 participate in cooling or heating can be controlled.

When the dehumidification mode is needed, the high-temperature refrigerant flowing out of the compressor 180 enters the outdoor heat exchanger 130 (the condenser), and then the high-temperature refrigerant flowing out of the outdoor heat exchanger 130 reaches the first valve 510. At this time, the first valve 510 can be opened completely or largely, so that the temperature of the outdoor heat exchanger 130 is equal to or slightly smaller than the temperature of the first indoor heat exchanger 121. At this time, the first indoor heat exchanger 121 is a condenser, and plays a role of heating the airflow. Then the secondary high-temperature refrigerant flowing out of the first indoor heat exchanger 121 reaches the second valve 520, and the second valve 520 is partially opened to play a role of capillary throttling. The refrigerant after being throttled becomes the low-temperature refrigerant and the low-temperature refrigerant flows through the second indoor heat exchanger 122. The second indoor heat exchanger 122 at this moment is an evaporator to play a cooling role, namely dehumification. The refrigerant flowing out of the second indoor heat exchanger 122 returns to the compressor 180. In this way, a portion of the mixture of the fresh air and the indoor air is heated by the first indoor heat exchanger 121, and another portion of the mixture is cooled and dehumidified by the second indoor heat exchanger 122, and both portions enter the indoor air duct 103 to be mixed to form a drying airflow with a suitable temperature, and then are blown out through the indoor air outlet, so that the purpose of dehumidification without cold air blowing to the indoors is achieved, and the dehumidification effect is better. The first indoor heat exchanger 121 may be used as an evaporator, and then the second indoor heat exchanger 122 is used as a condenser, and the purpose of constant temperature and dehumidification can also be achieved.

When dehumidification is not needed, and only a cooling only mode is needed, the high-temperature refrigerant flowing out of the compressor 180 enters the outdoor heat exchanger 130 (the condenser), and the high-temperature refrigerant flowing out of the outdoor heat exchanger 130 reaches the first valve 510. At this time, the first valve 510 is opened slightly to play a role of capillary throttling, so that the temperature of the first indoor heat exchanger is much lower than the temperature of the outdoor heat exchanger. At this moment, the first indoor heat exchanger 121 is an evaporator and plays a role of cooling, and then the low-temperature refrigerant flowing out of the first indoor heat exchanger 121 reaches the second valve 520. The second valve 520 is opened completely or largely to let the entire of the low-temperature refrigerant to pass through or play a role of throttling to the low-temperature refrigerant. the refrigerant flowing through the second valve 520 flows through the second indoor heat exchanger 122. At this moment, the second indoor heat exchanger 122 is an evaporator, and plays a role of cooling further. The refrigerant flowing out of the second indoor heat exchanger 122 returns to the compressor 180. In this way, the fresh air and the indoor air are mixed and then cooled by the first indoor heat exchanger 121, and then enter the indoor air duct 103 and are blown out through the indoor air outlet, so that the purpose of rapid cooling the indoors can be achieved.

Referring to FIG. 2 and FIG. 20, in an embodiment, the refrigerant circulation pipeline includes a first pipe 610 connected to the exhaust pipe 181 and the outdoor heat exchanger 130, and a second pipe 620 connected to the suction pipe 182 and the second indoor heat exchanger 122. The window air conditioner further includes a switching device 700. The switching device 700 is connected on both the first pipe 610 and the second pipe 620, and has a first switching state and a second switching state. In the first switching state, two portions of the first pipe 610, which are distributed on both sides of the switching device 700, are communicated with each other, and two portions of the second pipe 620, which are distributed on both sides of the switching device 700, are also communicated with each other. In the second switching state, the portion of the first pipe 610, which is located between the exhaust pipe 181 and the switching device 700 is communicated with the portion of the second pipe 620, which is located between the switching device 700 and the second indoor heat exchanger 122, and the portion of the first pipe 610, which is located between the outdoor heat exchanger 130 and the switching device 700 is communicated with the portion of the second pipe 620, which is located between the suction pipe 182 and the switching device 700.

In this embodiment, it can be understood that the window air conditioner further includes a controller, and the controller is electrically connected to the first valve 510, the second valve 520 and the switching device 700, to control a switching state of the switching device 700, the open or close of each valve and the opening degree of each valve. The switching device 700 may be a four-way valve or another switching device 700 which makes the refrigerant not enter the outdoor heat exchanger 130 and the second indoor heat exchanger 122 at the same time, so that the functions of the air conditioner can be increased. It can be understood that the switching device 700 is connected in series on the first pipe 610 and the second pipe 620, that is, two ends of the switching device 700 communicate with the first pipe 610, and two ends of the switching device 700 communicate with the second pipe 620.

When the switching device 700 is in the first switching state, the high-temperature refrigerant flowing out of the exhaust pipe 181 of the compressor 180 flows to the outdoor heat exchanger 130 through the first pipe 610, then flows into the first indoor heat exchanger 121 and the second indoor heat exchanger 122 in sequence, and finally flows back to the compressor 180 through the second pipe 620 and the suction pipe 182. By controlling the opening degrees of the first valve 510 and the second valve 520, the first indoor heat exchanger 121 can be controlled to be in the cooling state or the heating state, so that the whole system can be controlled to be in the constant-temperature dehumidification mode or to be a full cooling system. The first indoor heat exchanger 121 being controlled to be in the cooling state or the heating state by the first valve 510 and the second valve 520 is similar to the above embodiments without switching states, and details are not repeated herein for brevity.

When the switching device 700 is in the second switching state, the high-temperature refrigerant flowing out of the exhaust pipe 181 of the compressor 180 flows into the second indoor heat exchanger 122 through the first pipe 610 and the second pipe 620, then flows to the first indoor heat exchanger 121 and the outdoor heat exchanger 130, and finally flows back to the compressor 180 through the first pipe 610, the second pipe 620 and the suction pipe 182.

When a heating only mode is turned on, the switching device 700 is in the second switching state, and the high-temperature refrigerant flowing out of the exhaust pipe 181 of the compressor 180 flows into the second indoor heat exchanger 122 through the first pipe 610 and the second pipe 620. At this time, the second indoor heat exchanger 122 serves as a condenser and plays a role of heating, and the high-temperature refrigerant flowing out of the second indoor heat exchanger 122 reaches the second valve 520 which is fully opened. The high-temperature refrigerant flows to the first indoor heat exchanger 121 which plays a role of heating. The secondary high-temperature refrigerant reaches the first valve 510 and the first valve 510 plays a role of capillary throttling. After that the refrigerant becomes the low-temperature refrigerant, flows through the outdoor heat exchanger 130 and back to the compressor 180. In this way, the rapid heating of the indoors is realized.

The above are only preferred embodiments of this application, and are not intended to limit the patent scope of this application. Any equivalent structural transformation made by using the specification and drawings of this application, or any direct/indirect application to other related technical fields under the inventive concept of this application, is included in the claimed scope of this application.

What is claimed is:

1. A window air conditioner comprising:

a casing configured with an indoor air inlet and an indoor air outlet;

an indoor heat exchanger provided in the casing and corresponding to the indoor air inlet;

an indoor wall provided in the casing and configured with an indoor air duct for communicating an air outlet side of the indoor heat exchanger with the indoor air outlet; and a fresh air housing provided in the casing and configured with a fresh air inlet, and a first fresh air outlet and a second fresh air outlet in communication with the fresh air inlet, wherein the first fresh air outlet is located on an air inlet side of the indoor heat exchanger, and the second fresh air outlet is in communication with the indoor air duct.

2. The window air conditioner according to claim 1, wherein the fresh air housing comprises:

an air inlet portion provided with the fresh air inlet, an air outlet portion located between the indoor heat exchanger and the indoor air inlet, and an air guiding portion for communicating the air inlet portion with the air outlet portion, wherein the air outlet portion is provided with the first fresh air outlet and the air guiding portion is provided with the second fresh air outlet.

3. The window air conditioner according to claim 2, wherein:

a mounting opening is formed on a rear wall plate of the indoor wall, the air guiding portion is provided behind the indoor wall, the air guiding portion comprises an air guiding wall arc-shaped, the air guiding wall extends downward from a top wall of the air inlet portion to a top wall of the air outlet portion, and the air guiding wall is provided with the second fresh air outlet, and the second fresh air outlet extends into the indoor wall from the mounting opening to communicate with the indoor air duct.

4. The window air conditioner according to claim 2, wherein:

the fresh air housing further comprises an air directing portion for communicating the air guiding portion with the air outlet portion, and the air directing portion is of a flat shape and extended from the air guiding portion, passed through a lower end of the indoor heat exchanger and connected to a lower end of the air outlet portion.

5. The window air conditioner according to claim 2, wherein:

the first fresh air outlet is opened towards the indoor air inlet; or the first fresh air outlet is opened towards an air inlet side of the indoor heat exchanger; or the first fresh air outlet is opened upward.

6. The window air conditioner according to claim 2, further comprising a first air guiding member provided at the first fresh air outlet, wherein the first air guiding member is configured to guide fresh air to blow obliquely downward into indoors from the first fresh air outlet.

7. The window air conditioner according to claim 6, wherein:

an upper wall plate is located at a top of the air outlet portion, and a front edge of the upper wall plate forms an upper edge of the first fresh air outlet; and a surface of the upper wall plate is inclined downward from a rear side to a front side of the upper wall plate, and the first air guiding member is formed by the upper wall plate.

8. The window air conditioner according to claim 7, wherein the indoor air inlet is provided with a plurality of air inlet louvers arranged at intervals in an up-down direction, air inlet louvers located at a lower end of the indoor air inlet correspond to the first fresh air outlet, and surfaces of the air inlet louvers are inclined downward from a rear side to a front of the air inlet louvers.

9. The window air conditioner according to claim 8, wherein a rear edge of at least one air inlet louver corresponds to a front edge of the upper wall plate of the air outlet portion, and an inclination angle of the at least one air inlet louver is consistent with an inclination angle of the upper wall plate.

10. The window air conditioner according to claim 2, wherein:

the fresh air housing further comprises a wind deflector configured on the air outlet portion, and the wind deflector is located at or close to an upper edge of the first fresh air outlet and extends along a length direction of the upper edge of the first fresh air outlet; and the window air conditioner further comprises an air inlet filter screen disposed between the indoor heat exchanger and the indoor air inlet, the wind deflector is located behind the air inlet filter screen, and a front surface of the wind deflector is abutted against a rear surface of the air inlet filter screen.

11. The window air conditioner according to claim 1, further comprising:

an air duct housing arranged in the indoor wall to form the indoor air duct, wherein an air supply port is formed on the air duct housing to communicate the second fresh air outlet with the indoor air duct; and a second air guiding member provided at the air supply port and configured for guiding air to an indoor fan.

12. The window air conditioner according to claim 11, wherein:

the second air guiding member comprises at least one air guiding plate arranged at the air supply port, and a surface of the at least one air guiding plate is inclined towards the indoor fan from a lower edge of the at least one air guiding plate to an upper edge of the at least one air guiding plate; or the second air guiding member comprises an air guide cylinder protruding from an inner periphery of the air supply port, and an outlet of the air guide cylinder is opposite to the indoor fan.

13. The window air conditioner according to claim 12, wherein:

the air supply port comprises a plurality of strip-shaped ventilation holes distributed along an up-down direction; and the at least one air guiding plate comprises a plurality of air guiding plates, the plurality of air guiding plates are corresponding to the plurality of strip-shaped ventilation holes by one-to-one correspondence, a lower side of each air guiding plate is connected to a lower edge of a corresponding strip-shaped ventilation hole, and inclined directions of surfaces of the plurality of air guiding plates are consistent with each other.

14. The window air conditioner according to claim 13, wherein the fresh air housing comprises:

an air inlet portion provided with the fresh air inlet, an air guiding portion extending forward from the air inlet portion to a back surface of an air duct back plate, wherein the air guiding portion comprises:

a first air guiding section connected with the air inlet portion, wherein a top wall of the first air guiding section is inclined downward from the air inlet section and a narrowed opening is formed at a terminal end of the first air guiding section; and a second air guiding section extending forward from the first air guiding section, wherein the second air guiding section comprises a front wall corresponding to the narrowed opening and the second fresh air outlet is formed on the front wall; and an air outlet portion in communication with the air guiding portion and located between the air inlet side of the indoor heat exchanger and the indoor air inlet, wherein the air outlet portion is provided with a first fresh air outlet.

15. The window air conditioner according to claim 1, further comprising:

a first air door configured at the first fresh air outlet, and movable relative to the first fresh air outlet to open or close the first fresh air outlet; and/or a second air door configured at the second fresh air outlet, and movable relative to the second fresh air outlet to open or close the second fresh air outlet.

16. The window air conditioner according to claim 1, further comprising:

a fresh air fan provided in the fresh air housing and located between the fresh air inlet and the second air outlet; and a filter provided in the fresh air housing, and located between the fresh air inlet and the fresh air fan or between the fresh air fan and the second air outlet.

17. The window air conditioner according to claim 1, wherein:

the indoor heat exchanger of the window air conditioner comprises a first indoor heat exchanger and a second indoor heat exchanger corresponding to the indoor air inlet, the first indoor heat exchanger and the second indoor heat exchanger are provided in a stacked manner along an air inlet direction of the indoor air inlet, or are provided side by side in a direction perpendicular to the air inlet direction, and the window air conditioner has a constant-temperature dehumidification mode, wherein one of the first indoor heat exchanger and the second indoor heat exchanger is in a heating state and the other of the first indoor exchanger and the second indoor heat exchanger is in a cooling state in the constant-temperature dehumidification mode.

18. The window air conditioner according to claim 17, wherein:

the window air conditioner further comprises an outdoor heat exchanger, a refrigerant circulation pipeline, a first valve and a second valve;

a refrigerant outlet of a compressor of the window air conditioner is provided with a exhaust pipe, and a refrigerant inlet of the compressor is provided with a suction pipe;

the exhaust pipe, the outdoor heat exchanger, the first indoor heat exchanger, the second indoor heat exchanger and the suction pipe are sequentially communicated through the refrigerant circulation pipeline; and the first valve is provided on a portion of the refrigerant circulation pipeline located between the outdoor heat exchanger and the first indoor heat exchanger, and the second valve is provided on a portion of the refrigerant circulation pipeline located between the first indoor heat exchanger and the second indoor heat exchanger.

19. The window air conditioner according to claim 18, further comprising a switching device, wherein:

the refrigerant circulation pipeline comprises a first pipe connecting the exhaust pipe with the outdoor heat exchanger, and a second pipe connecting the suction pipe with the second indoor heat exchanger; and the switching device is connected to the first pipe and the second pipe, and comprises:

a first switching state, wherein in the first switching state, two portions of the first pipe, which are located at two sides of the switching device, are communicated with each other, and two portions of the second pipe, which are located at the two sides of the switching device, are communicated with each other; and a second switching state, wherein in the second switching state, a portion of the first pipe, which is located between the exhaust pipe and the switching device, is communicated with a portion of the second pipe, which is located between the switching device and the second indoor heat exchanger, and another portion of the first pipe, which is located between the outdoor heat exchanger and the switching device, is communicated with another portion of the second pipe, which is located between the suction pipe and the switching device.

20. The window air conditioner according to claim 19, further comprising a controller electrically connected to the switching device, the first valve and the second valve, wherein:

when the window air conditioner is in the constant-temperature dehumidification mode, the controller is configured to control the switching device to be in the first switching state, the first valve to be fully opened, and the second valve to be partially opened; and/or when the window air conditioner is in a cooling only mode, the controller is configured to control the switching device to be in the first switching state, the first valve to be partially opened, and the second valve to be fully opened; and/or when the window air conditioner is in a heating only mode, the controller is configured to control the switching device to be in the second switching state, the second valve to be fully opened, and the first valve to be partially opened.

* * * * *